US007521628B2

(12) United States Patent
Armstrong-Muntner

(10) Patent No.: US 7,521,628 B2
(45) Date of Patent: Apr. 21, 2009

(54) ELECTRICAL MUSICAL INSTRUMENT WITH USER INTERFACE AND STATUS DISPLAY

(75) Inventor: Joel Armstrong-Muntner, 3740 Judan St., San Francisco, CA (US) 94122

(73) Assignee: Joel Armstrong-Muntner, San Francisco, CA (US)

( * ) Notice: Subject to any disclaimer, the term of this patent is extended or adjusted under 35 U.S.C. 154(b) by 0 days.

(21) Appl. No.: 11/784,242

(22) Filed: Apr. 4, 2007

(65) Prior Publication Data

US 2007/0251374 A1 Nov. 1, 2007

Related U.S. Application Data

(60) Provisional application No. 60/789,665, filed on Apr. 5, 2006.

(51) Int. Cl.
*G10H 1/02* (2006.01)

(52) U.S. Cl. ..... 84/737; 84/723; 84/725; 84/735

(58) Field of Classification Search ..... None
See application file for complete search history.

(56) References Cited

U.S. PATENT DOCUMENTS

| | | | | |
|---|---|---|---|---|
| 4,175,462 | A | 11/1979 | Simon | |
| 4,305,320 | A | 12/1981 | Peavey | |
| 4,711,149 | A | 12/1987 | Starr | |
| 4,817,486 | A | 4/1989 | Saunders | |
| 5,136,919 | A | 8/1992 | Wolstein | |
| 5,311,806 | A | 5/1994 | Riboloff | |
| 5,763,808 | A | 6/1998 | Thomson | |
| 5,780,760 | A | 7/1998 | Riboloff | |
| 5,866,834 | A | 2/1999 | Burke et al. | |
| 5,932,827 | A * | 8/1999 | Osborne et al. | 84/726 |
| 6,121,537 | A | 9/2000 | Pawar et al. | |
| 6,316,713 | B1 | 11/2001 | Furst et al. | |
| 6,781,050 | B2 | 8/2004 | Olvera et al. | |
| 6,881,891 | B1 | 4/2005 | Limacher et al. | |
| 6,888,057 | B2 | 5/2005 | Juskiewicz et al. | |
| 7,115,810 | B2 | 10/2006 | Ambrosino | |

* cited by examiner

*Primary Examiner*—Marlon T Fletcher
(74) *Attorney, Agent, or Firm*—Klein, DeNatale, Goldner, Cooper et al.; James M. Duncan

(57) ABSTRACT

A string musical instrument, such as an electric guitar, comprises a plurality of sound pickups and a user interface which allows the user rapid access to various configurations of pickup settings and connections. An embodiment of the musical instrument has a user interface which allows quick access to all forty-seven possible pickup connections available in a guitar having three single-coil pickups. Another embodiment of the invention allows rapid to access a large number of possible pickup connections made possible with the use of dual coil pickups, or a combination of single-coil and dual-coil pickups on a single guitar. The different pickup configurations are accessed via user operated controls such as clear illuminated momentary buttons or touch pads. Although the musical instrument provides a large number of accessible pickup configurations, a user display makes the determination of the pickup configuration intuitive and relatively simple.

20 Claims, 11 Drawing Sheets

Three Single Coil Pickups and Touch Pads

Microcontroller and Connections for Three-Dual-Coil Models

Pickups and Mini-Joysticks for Three-Dual-Coil Model

Three Dual Coil Multiplex Connections

| Three Dual Coil MUX's Connections | | | |
|---|---|---|---|
| Chip Design Name | Pickup Coil Connection (to Chip Signal Mux Common) | | |
| MULTX 1 | NF+ | MX1 | /LE1 |
| MULTX 2 | NF- | MX2 | /LE2 |
| MULTX 3 | NR+ | MX3 | /LE3 |
| MULTX 4 | NR- | MX4 | /LE4 |
| MULTX 5 | BF+ | MX5 | /LE5 |
| MULTX 6 | BF- | MX6 | /LE6 |
| MULTX 7 | BR+ | MX7 | /LE7 |
| MULTX 8 | BR- | MX8 | /LE8 |
| MULTX 9 | MF+ | MX9 | /LE9 |
| MULTX 10 | MF- | MX10 | /LE10 |
| MULTX 11 | MB+ | MX11 | /LE11 |
| MULTX 12 | MB- | MX12 | /LE12 |

ELECTRICAL MUSICAL INSTRUMENT WITH USER INTERFACE AND STATUS DISPLAY

CROSS-REFERENCE TO RELATED APPLICATION

U.S. Provisional Application No. 60/789,665 for this invention was filed on Apr. 5, 2006 for which the inventor claims domestic priority.

BACKGROUND OF THE INVENTION

The present invention generally relates to electrical musical instruments, such as electric guitars, which might have single and/or dual coil pickups. It more specifically relates to a user interface and visual display which allows a user to readily change between different combinations of pickups where the particular pickup configuration is displayed on the front of the instrument.

Manufacturers have long striven to provide musicians with an ever-wider palette of sounds to choose from while playing electric guitar or similar musical instruments that employ transducers (generally magnetic pickups) to capture or translate the vibration of strings and induced instrument body resonances to an electrical signal of varying voltage for the purpose of signal amplification and manipulation into a musical creation. There exist three interrelated areas of electric stringed instrument design art that come into play in all attempts to achieve a novel, useful improvement to this end. These are:

1) A manageable set of the many various possible pickup (transducer) combinations, (wiring arrangements) typically pre-selected by the manufacturer.
2) Means for selecting amongst these various arrangements; e.g. toggle or rotary switches or other means.
3) A visual or other indicator of musician's selection, e.g., a large, easy to see (or feel) toggle switch.

In recent years there have been a number of attempts to widen the electric-(or amplified)-stringed-instrument musician's access to a greater set of sounds resulting from more numerous pickup combinations. Many recent attempts to this end employ some form of logic-controlled-switching of the pickup interconnections, and intra-connections, to offer a greater number of possibilities than are practical or desirable through the use of strictly manually operated switches of any sort. To date these attempts have done one or the other of either limiting the number of musician selectable combinations through either a reduced set of the total possible combinations possible with a given instrument's compliment of pickups by:

A) Pre-limiting the total choices, or providing the user with assigned selectable "banks" of sounds via RAM or similar memory that may be set and then later called up by the user; depending on for instance, the type of song being played.
B) Offering a continuous dial or scroll-wheel through which the musician can dial-in a desired pickup combination.

The drawbacks for Option A are that the musician is still working with a less than ultimate selection of pickup combinations to select from, though utilizing a somewhat manageable user interface. Even so, many of the attempts to do this require the user to memorize the push/pull knob settings with scant direct indication of the pickup combination selected. In other words, for example the musician/user must know that with the front knob pulled up, second knob down, and 5-way selector in position 2, the user has chosen the neck pickup in parallel with the other pickups in series. This approach requires a lot of toggling of the switches and a great deal of memorization.

The drawback for Option B, the use of a scroll-wheel or similar interface, is the difficulty of quickly selecting the desired pickup combination in real-time, such as doing so in the middle of a song. Because a desired pickup configuration may not be stored in adjacent or nearby positions of the scroll-wheel, the user is relegated to a scrolling hunt to find the desired pickup configuration.

Other efforts have been made to provide a musician-user with rapid access to different pickup configurations. These systems have employed either an overly large number of toggle switches, buttons, push/pull switches and/or knobs as a means of user interface. Moreover, the status displays of these systems have also been less than satisfactory. Some display the user's selection on a liquid-crystal display or similar display. The shortcoming with this type of display is that it is difficult to view on a stringed musical instrument, unlike the situation with an electric keyboard, where this type of display is perhaps more suitable. In particular, an electric guitar is often worn on a strap, and may be routinely subjected to sharp motions and shock, and is worn at a relatively great distance from the user's eyes. Other attempts have employed a veritable constellation of light emitting diodes ("LEDs"), arrayed about the instrument, as visual indication of the user selection. The problem with this type of display is that the user must employ a great deal of mental processing to ascertain the chosen pickup selection while simultaneously performing the musical work. This difficulty makes selection interactions and determination of pickup settings a tedious task.

The result of the systems described above has been less than satisfactory, in that these attempts have fallen short of providing an easy way for the musician to quickly switch to a different desired pickup configuration with surety and to know which pickup configuration is in effect at a given time.

SUMMARY OF THE INVENTION

The present invention comprises a string musical instrument which has a plurality of sound pickups. The musical instrument comprises a user interface, which utilizes a user-operated control which allows quick access to combinations of various pickup connections. For example, an embodiment of the apparatus allows quick access to all forty-seven possible pickup connections (wiring configurations) available in a guitar having three single-coil pickups. Another embodiment of the invention allows rapid to access a large number of possible pickup connections made possible with the use of dual-coil ("humbucker") pickups, or a combination of single-coil and dual-coil pickups on a single guitar. These different pickup configurations are accessed via user operated controls such as clear illuminated momentary buttons or touch pads which may be conveniently mounted in the instrument's pickguard or other location. Although the disclosed musical instrument provides a large number of different pickup configurations which are accessible by the user, changing the pickup configuration and determining the status of the configuration is intuitive and relatively simple. Processing means are utilized to ascertain the bus configuration required to transmit the electrical signals from the sound pickups to the output jack of the musical instrument. A display means connected to the processing means provides a unique display for each pickup configuration.

An embodiment of the user-interface/user-control system utilized in the disclosed musical instrument is accomplished through the use of a microcontroller (i.e., the logic controlled interpretation of user input and corresponding switching of the analog transducer (pickup) signals) and LED's).

DETAILED DESCRIPTION OF THE EMBODIMENTS

Figure 1:
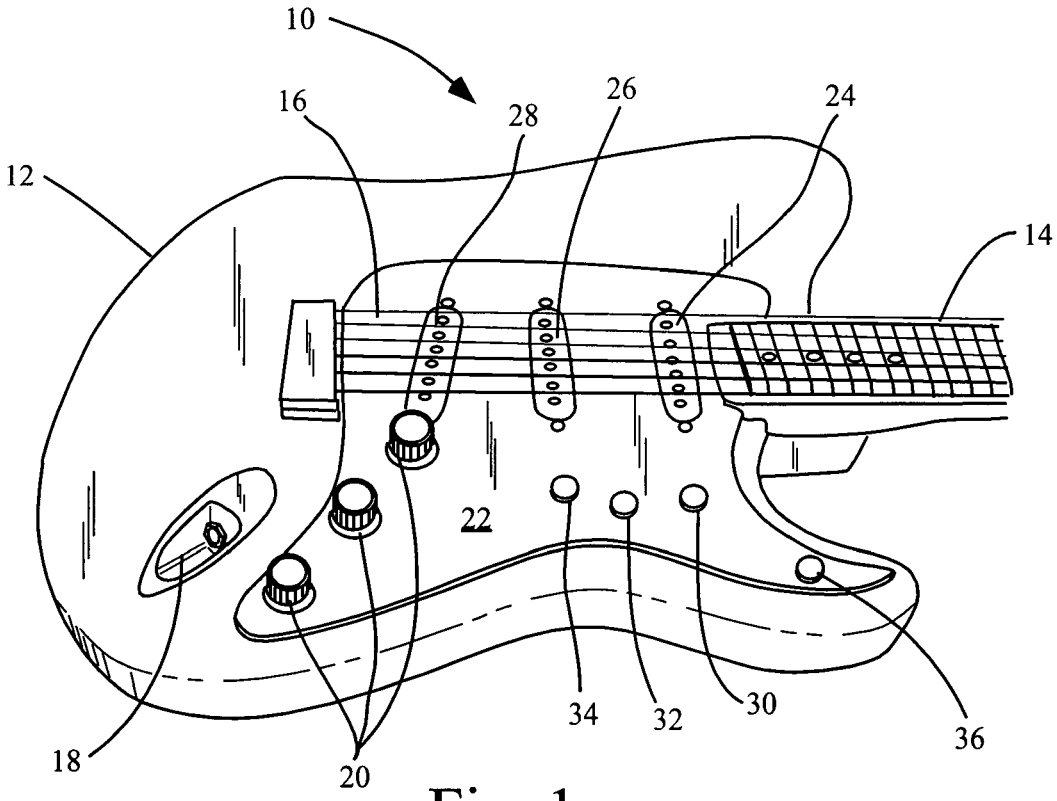
FIG. 1 shows the general configuration of a three single-coil pickup instrument, such as a guitar, and one possible configuration for location of illuminated momentary buttons which may be used for setting the pickup configuration of the instrument.

Referring now specifically to the drawings, FIG. 1 shows an embodiment of the disclosed musical instrument 10. This embodiment comprises a body 12, neck 14, strings 16, an output connector 18, volume and tone controls 20, and pick guard 22. This embodiment further comprises single coil neck pickup 24, single coil mid pickup 26 and single coil bridge pickup 28. The invention comprises user operated controls which allow the user to selectively connect the coils in different combinations to achieve any one of a number of different achievable combinations. The user operated controls may comprise clear illuminated momentary buttons, touch pads, or joystick types of controls. For example, FIG. 1 shows an embodiment of the musical instrument 10 utilizing a momentary touch button 30 which is generally used to select the settings for the neck pickup 24. Likewise, momentary touch button 32 is generally used to select the settings for the mid pickup 26 and momentary touch button 34 is generally used to select the settings for the bridge pickup 28. Each momentary touch button 32 comprises an integral light emitting diode, which may include bi-color LEDS or RGB LEDS. As discussed in greater detail below, these light emitting diodes comprise a display means which provides a unique display which indicates a particular configuration of the settings of the pickup coils. Musical instrument 10 may further comprise access button 36 which may be utilized, among other uses, as a scrolling device to access preset pickup configurations which may be stored in nonvolatile memory.

Figure 2:
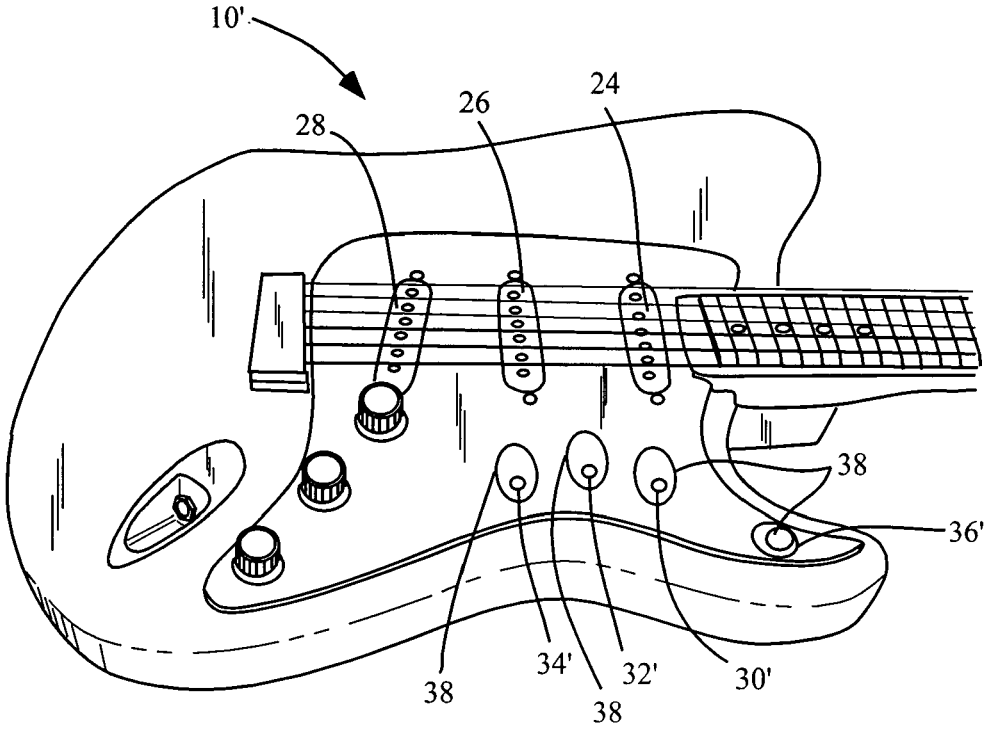
FIG. 2 shows an alternative embodiment of a three single-coil pickup instrument, such as a guitar, showing a possible configuration for location of illuminated touch pads which may be used for setting the pickup configuration of the instrument.

FIG. 2 shows an embodiment of the musical instrument 10' which has the same general components as the embodiment discussed above, except that the user operated controls comprise a plurality of touch pads, which may comprise neck pad 30', mid pad 32' and bridge pad 34'. Each touch pad may further comprise an light emitting diode 38, which is utilized to provide a visual display of the pickup configuration. This embodiment of the musical instrument 10' may also comprise access pad 36'.

Figure 3:
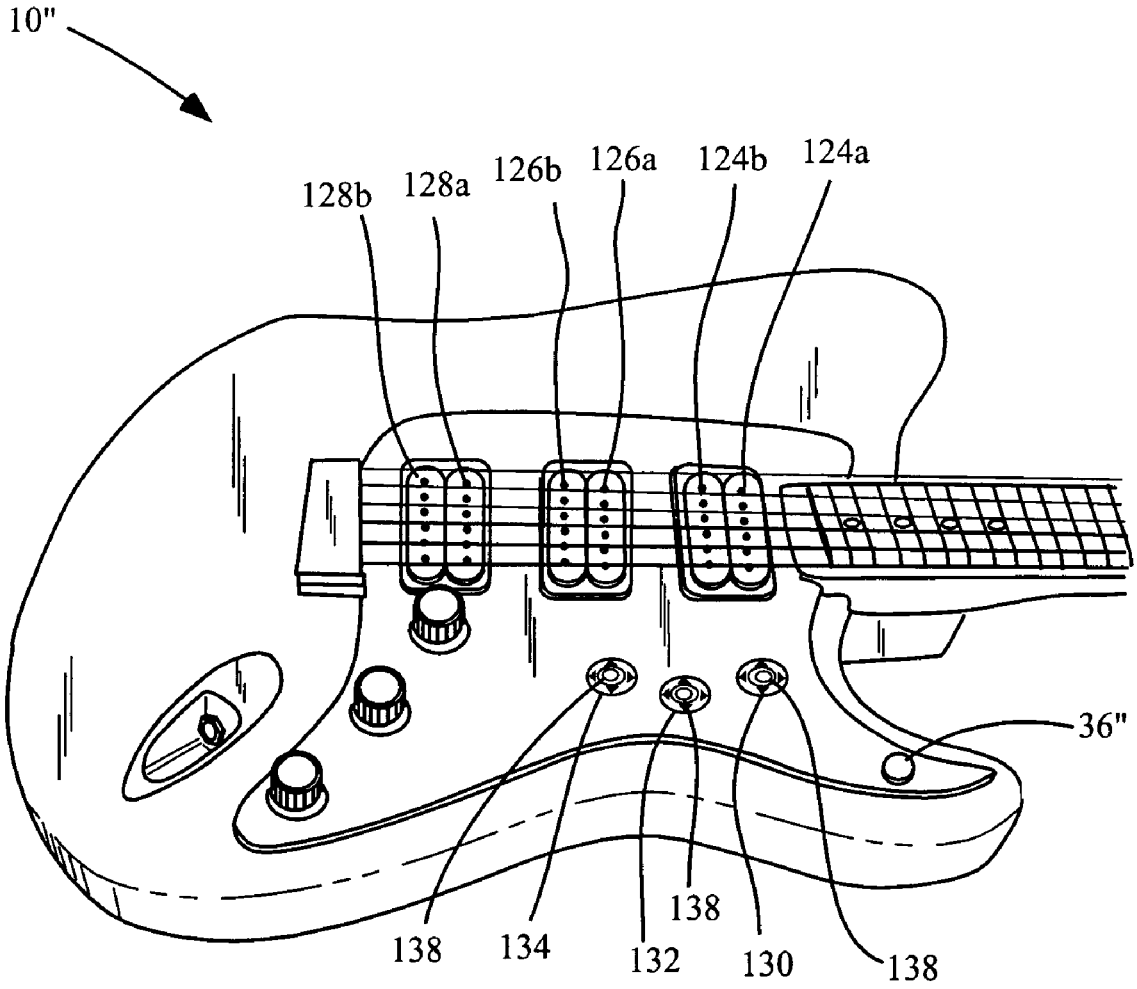
FIG. 3 shows the general configuration of a three double-coil pickup instrument, such as a guitar, and one possible configuration for location of an illuminated joystick control which may be used for setting the pickup configuration of the instrument.

The user operated controls and related display means comprise a user interface which simplifies the task of selecting and identifying particular pickup combinations, while presenting the user with the complete range of pickup wiring selections available for a given instruments' pickup configuration, such as a typical, standard three-single coil pickup array generally found on the popular Fender Stratocaster as generally depicted in FIGS. 1 and 2. As shown in FIG. 1, momentary button 30, momentary button 32 and momentary button 34 may correspond, relatively, with neck pickup 24, mid pickup 26 and bridge pickup 28. Alternatively, as best shown in FIG. 2, the user operated controls may comprise touch pad 30', touch pad 32' and touch pad 34' which correspond, relatively, with neck pickup 24, mid pickup 26 and bridge pickup 28. Alternatively, as best shown in FIG. 3, the user operated controls may comprise joystick (or navigation switch) 130, joy stick 132, or joy stick 134, which correspond, relatively, with neck pickups 124*a*, 124*b*, mid pickups 126*a*, 126*b* and bridge pickups 128*a*, 128*b*. It is to be appreciated that while FIG. 3 shows a musical instrument 10" having dual coil pickups, the various user operated controls may be utilized for the different varieties of pickup.

Figure 4:
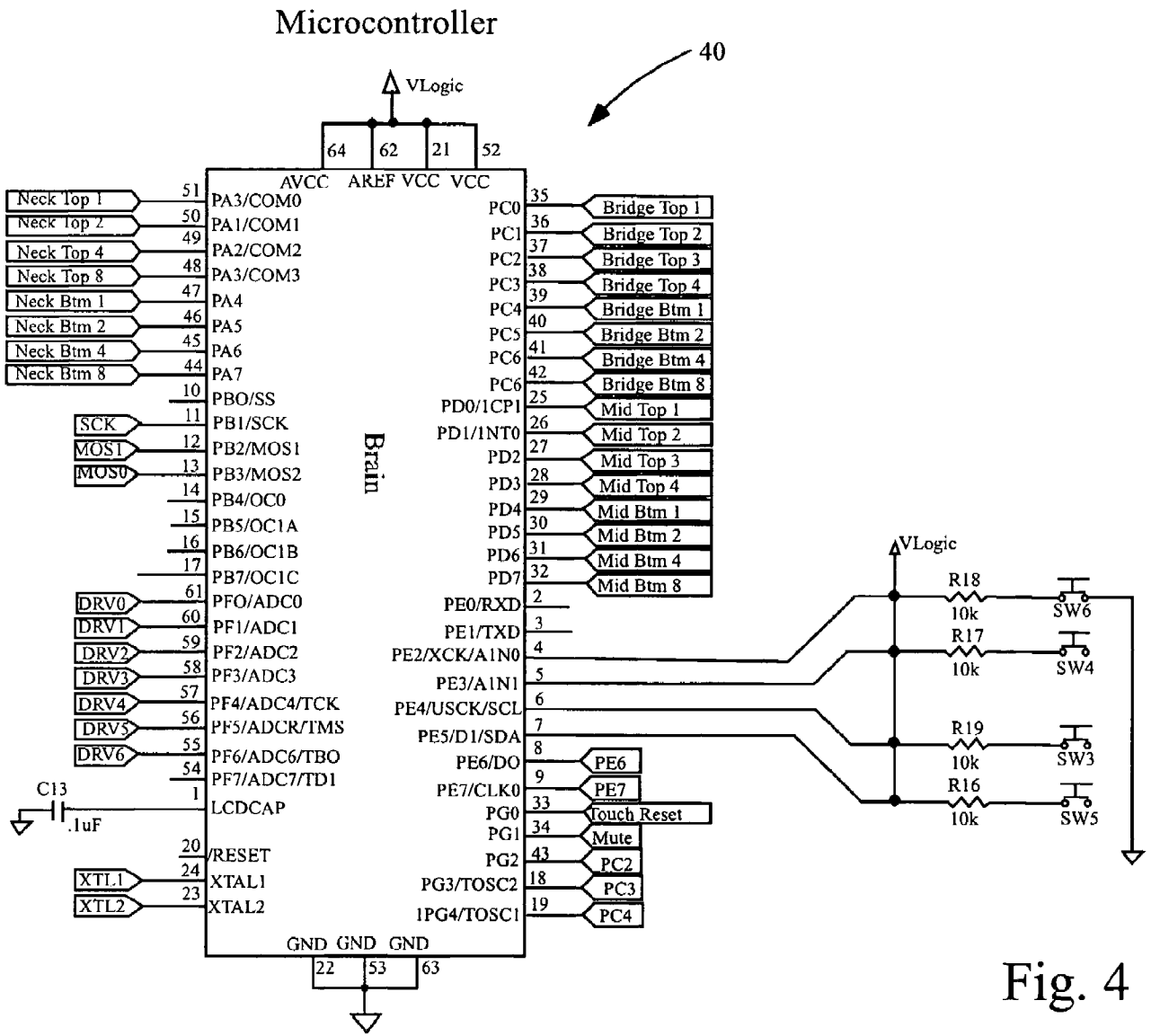
FIG. 4 shows a schematic of a microcontroller for an instrument having three single-coil pickups controlled by momentary buttons which may be used with an embodiment of the instrument.

As shown schematically in FIG. 4, an embodiment of the disclosed musical instrument 10' may comprise microcontroller 40 which is utilized to direct the necessary bus connections for achieving the desired pick-up configuration and transmitting the electrical signals from the pickups to the output means of the instrument 10, such as output connector 18. In addition, the microcontroller 40 interacts with the display means such that the display means shows the configuration of the pickup connections.

Figure 5:
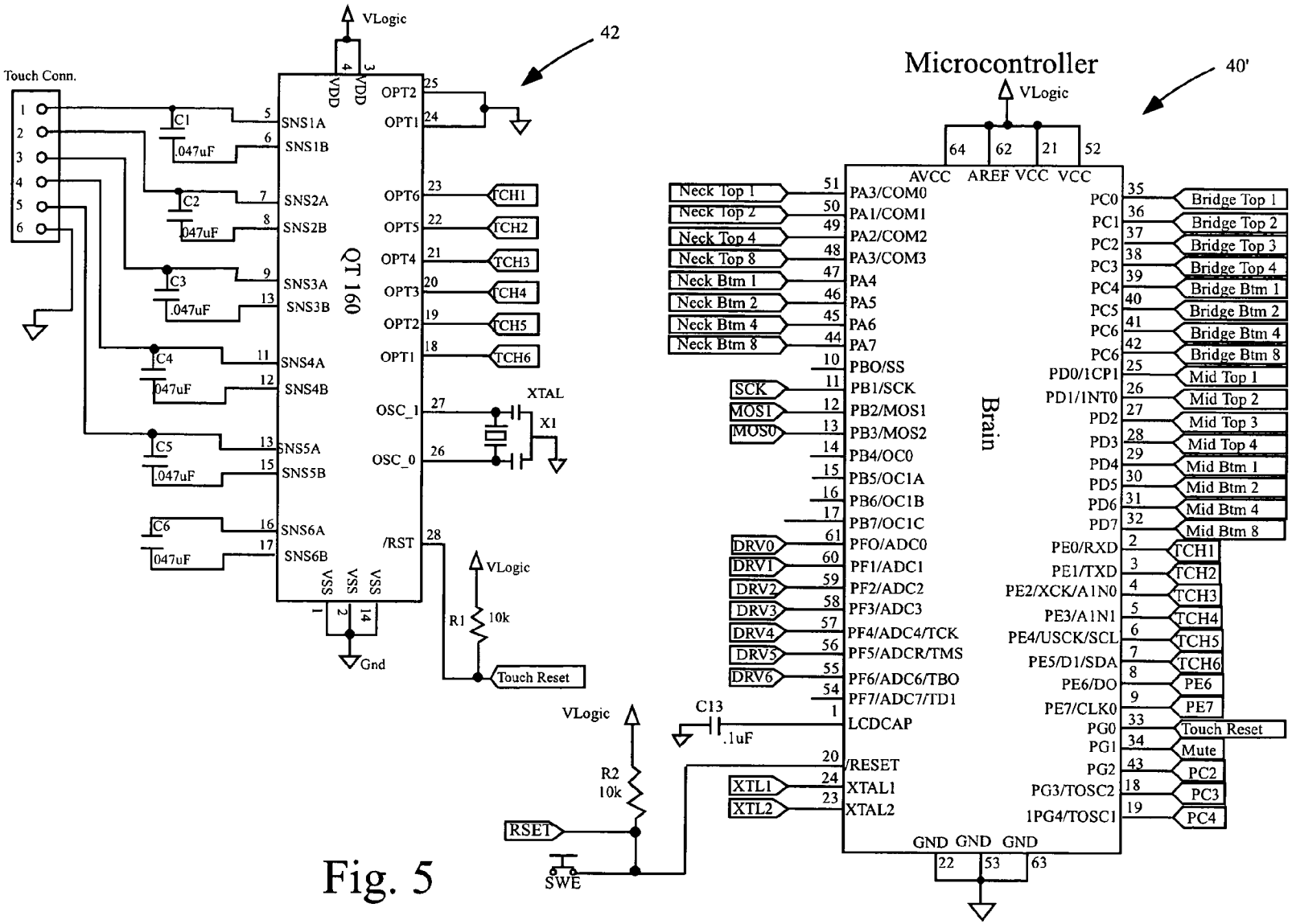
FIG. 5 shows a schematic of a microcontroller and touch sensor chip for an instrument having three single-coil pickups which may be used with an embodiment of the instrument controlled by touch pads.
Figure 6A:
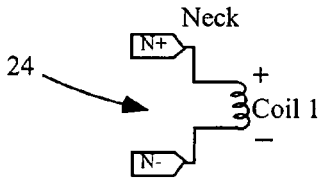
FIGS. 6A through 6G schematically show three single coil pickups, respectively for the neck, middle, and bridge positions of an instrument and the corresponding touch pads for each pickup and a touch pad for the access control.
Figure 6B:
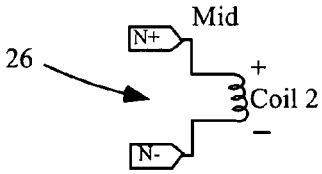
Figure 6C:
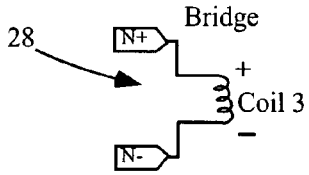
Figure 6D:
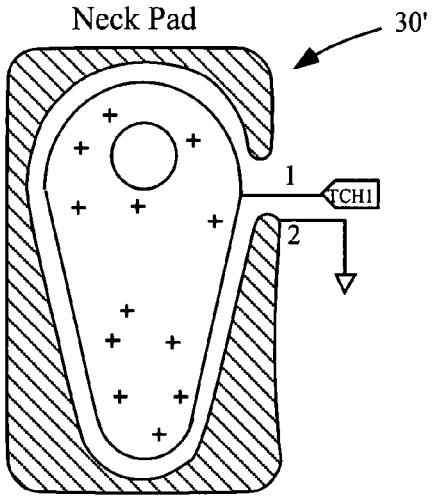
Figure 6E:
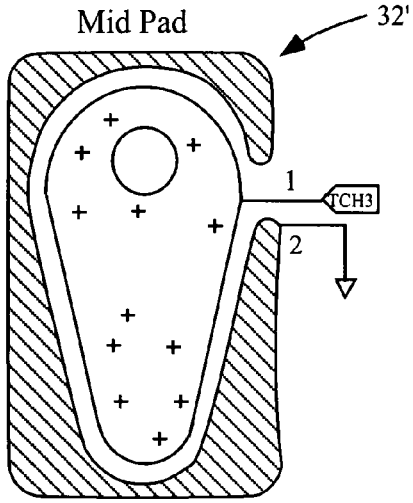
Figure 6F:
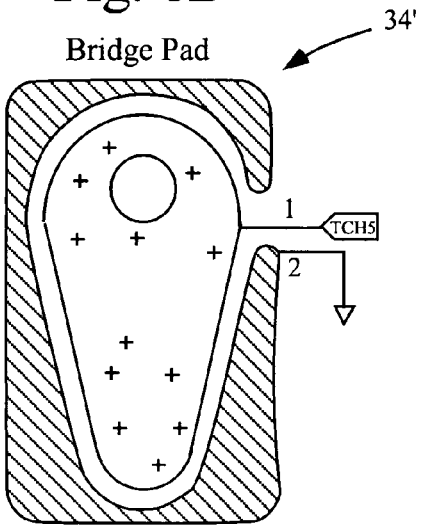
Figure 6G:
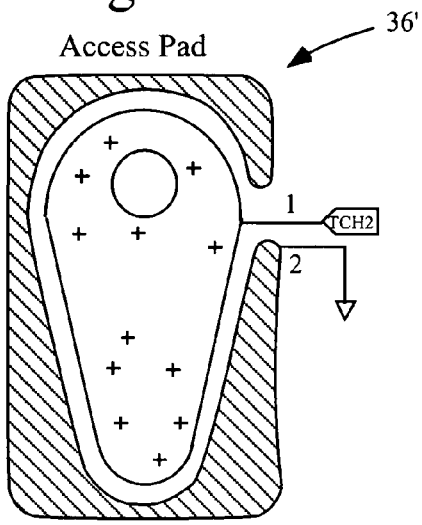

An embodiment of the disclosed musical instrument 10' may comprise touch pads 30', 32' and 34' as the user operated controls. In this embodiment, a separate processing chip 42 is required, as shown schematically in FIG. 5, which is used in conjunction with microcontroller 40'. A schematic of the touch pads 30', 32', 34' and the respective connectors to processing chip 42 is shown in FIG. 6.

In the case of a musical instrument having three single coil pickups, there are forty-seven acoustically unique pickup wiring configurations available from an electric guitar or other stringed instrument. (See table I of the following appendices.) Technically there exists an electrically opposite wiring arrangement for each of these forty-seven pickup wiring combinations. However, as perceived by the human ear, these exact-opposite-doubles are indistinguishable from their counterparts. The reference to forty-seven pickup wiring arrangements or combinations is made with respect to the standard complement of transducers (pickups) found on typical three-single coil pickup instruments. There are of course additional aural possibilities which may be achieved through the introduction of various inclusions of tone controls (using capacitors connected to enhance or deemphasize particular frequencies produced by the pickups), or other passive or active methods of varying the signal produced.

An embodiment of the disclosed musical instrument 10, 10' having three single coil pickups (or one or more dual coil pickups mounted instead of a single coil pickup) provides quick access to all forty-seven possible pickup connections available through the use of three illuminated momentary buttons 30, 32, 34 or touch-pads 30', 32', 34', each which may correspond to a related pickup In the case where the user operated controls comprise a momentary button or touch-pad, the function, to the user is the same: a momentary-type signal is provided to the microcontroller 40 for the duration that the button or touch-pad is depressed. The touch-pads or buttons may be arranged on the front of the instrument, such as on the pick guard 22, such that each touch-pad or button corresponds to a related pickup such that the layout of the pads/buttons emphasizes the one-to-one correspondence with the Neck, Mid, and Bridge pickups respectively. While the following discussion refers to momentary buttons, it is to be appreciated that for many purposes momentary buttons and touch-pads may be used interchangeably, as there are embodiments which may comprise either or both hardware options. As discussed below, use of the touch pads requires the use of an additional chip.

The user interface of the disclosed musical instrument allows the user to switch between all forty-seven acoustically non-redundant possible pickup configurations available with an instrument equipped with three single-coil pickups, in a quick, efficient manner. The interface may be approached or learned in an intuitive fashion. While there are abundant possibilities for pickup configuration, there only three rules to be learned and applied by the user.

The instrument comprises three momentary buttons representing the three pickups, respectively the neck pickup 24, the mid pickup 26, and the bridge pickup 28. This number of buttons is preferred because there is a simple one-to-one relationship between the buttons and the pickups. As shown in FIG. 1 the momentary buttons 30, 32, 34 may be arrayed on the pickguard 22 or other locations on the face of the instrument so as to enhance the relationship of the momentary buttons to the corresponding pickups, while maintaining an arrangement that allows easy access for players with average, larger or smaller hands. The buttons are lit from within or below with LEDs, including bi-color LEDS and RGB LEDS such that the target for the musicians finger is clearly visible.

The manner in which the illuminated buttons are lit may assist the user in determining the pickup configuration. Preferably, bi-color LEDs are employed for this purpose, such as red/green. In addition, the manner in which the illuminated buttons blink is utilized to simplify user feedback. With this configuration, there are only a couple of things the user must know (or discover through a couple minutes of playing the instrument) as opposed to requiring complicated instructions or charts. In particular, the display means of the instrument may be configured to respond as follows:

A) If a button is lit, the corresponding pickup is selected.

B) If buttons are the same color, the corresponding pickups are in-phase. If the buttons are of different colors, the corresponding pickups are out-of-phase.

C) If the buttons are lit simultaneously, the corresponding pickups are wired in a parallel arrangement; if buttons/pads are blinking in a sequential manner (one after the other), the corresponding pickups are wired in a series arrangement. The blinking arrangement is, to many, an intuitively sensible arrangement. For musicians, this helps to imbue the instrument with a warm feel. Indeed, the default blink rate may be chosen to be fast enough to ascertain the pickup arrangement at a glance, while still slow enough to be of a calming nature (though the user may choose to vary this rate).

D) Tapping a button will change the pickup wiring selection in a simple, easy to understand manner. As a simple example, if the bridge button 34 is lit, the bridge pickup 28 is on. Tapping either or both of the other two buttons 30, 32 will place the corresponding pickups 24, 26 in a series wiring arrangement with the bridge pickup 28 and the buttons will be lit is sequence to indicate this. If the user has selected the bridge pickup 28 to be in series with the neck pickup 24 and the mid pickup 26 in parallel with each other, all three pickups in-phase, the display means may be configured such that the buttons 30, 32, 34 are blinking thus: all green buttons in the following sequence: bridge button 34 lit first, then the other two buttons 30, 32 together and repeat. If, by way of further example, the user then taps the mid button 32, the mid pickup 26 will now be out-of-phase, and the mid button will be lit with the opposite color to the other two buttons, but having the same blinking sequence as before.

E) Holding a button a bit longer (say 0.3 sec.) will reset the selection to whichever button is touched (the one-to-one simplest relation). So, as a further example, holding down all three buttons will place all three pickups in parallel, and in-phase.

The interface of the disclosed musical instrument makes it possible to eliminate the need for any sort of user-preset banks of pickup configurations as utilized by many prior art instruments. The disclosed interface allows the user to rapidly switch from any given selection of pick-up selection to to any other by quick tapping of the momentary buttons (or touch-pads). The interface may be programmed to allow the user vary the overall speed in which taps are recognized by the instrument, allowing expert players to switch at a 'lightning-quick' pace, while novices or children may prefer to tap in changes to the pickup configuration at a slower pace.

An embodiment of the disclosed invention may comprise digitally controlled analog switches. In this embodiment, switches serve the function of relays,.that is the switches are controlled via an external source, which may comprise a microcontroller which orchestrates when and which switches are to be "flipped" or toggled on or off to provide the appropriate signal path(s) between the several pickups and the instrument's typical signal path, (i.e. through the volume-tone and output connector 18). Acceptable switching devices are those manufactured by Maxim/Dallas Semiconductor, and routinely employed for various analog signal routing purposes. These switches or relays may be arrayed as four switches on a single chip. However, the particular arrangement of four switches per chip, is not mandatory, and there are many simple substitutions that can be used, from one switch per chip to a larger number, perhaps including all of the necessary switches on a single chip.

An embodiment 10 of the disclosed instrument having three single coil pickups 24, 26, 28 calls for twenty-four individual switches or relays to handle the pickup switching. This number of relays allows for a single switch for each physical wire connection to a chosen pickup, in every pickup configuration.

As an alternative embodiment, the disclosed interface may comprise an auto-scrolling option which is accessed by a touch of a button or pad, such as access button 36. A quick touch of the access button 36 initiates hands-free auto-scrolling through all forty-seven (though the user can limit this to specific pickup combinations). The duration for which each sound is active is governed by and equal to the length of time the access button is depressed or held down. In this manner, the user can sequence the switching of sounds to match the beat of the music being played or strummed. If desired, a very fast setting may be selected in which the resulting sound is "aurally kaleidoscopic", and unique. Tapping any button halts this process. If the access button 36 is tapped to stop scrolling, the selection in effect before auto-scrolling will be returned to use. If, on the other hand, the other buttons 30, 32, 34 are touched to stop scrolling, the selection presently active will be set in use. Extra features associated within this mode of operation may comprise the ability to vary the speed of scrolling: increasing by holding down (for a bit longer than a tap) the neck button 30, or decreasing by holding down the bridge button 34.

Another optional feature which may be accessed using the access button 36 (accessed via a longer press) is to set the first pickup combination that becomes active when the guitar is turned on as a default. Any currently active pickup selection may be selected as the first-on in this manner. Alternatively, the instrument may be configured such that the first pickup combination that becomes active when power is supplied to the instrument is the same as the pickup combination which was active when power to the instrument was turned off.

Figure 7:
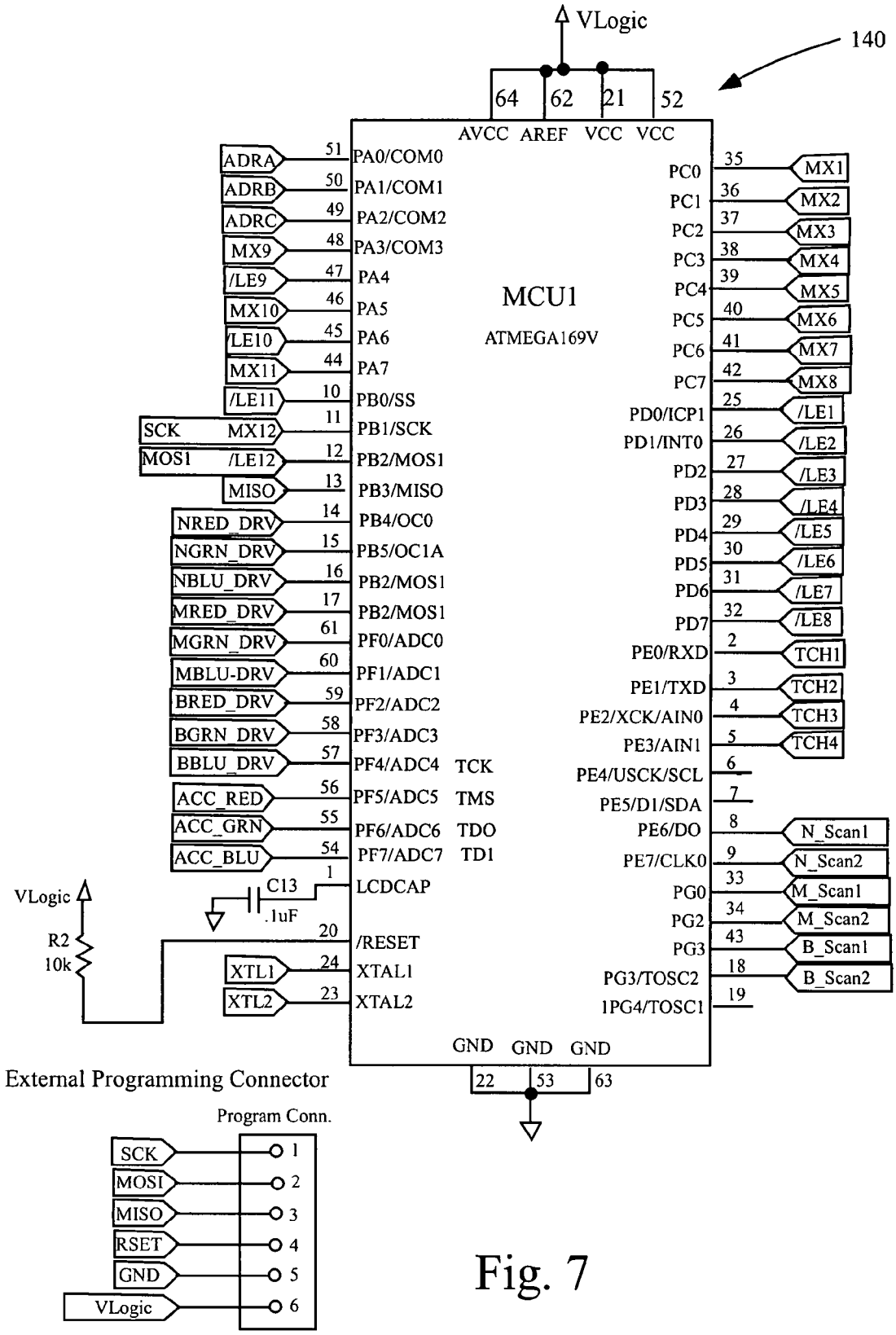
FIG. 7 shows a schematic of a microcontroller for an instrument having three dual-coil pickups.
Figures 8A, 8B, 8C, 8D:
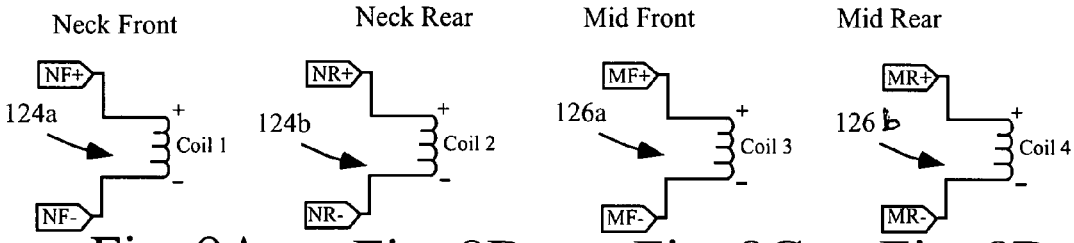
FIGS. 8A through 8I schematically show three double coil pickups, respectively for the neck, middle, and bridge positions of an instrument, and the corresponding joysticks (also referred to as navigation switches) which may be operated by the user to selectively connect the coils of the pickups.
Figure 8E:
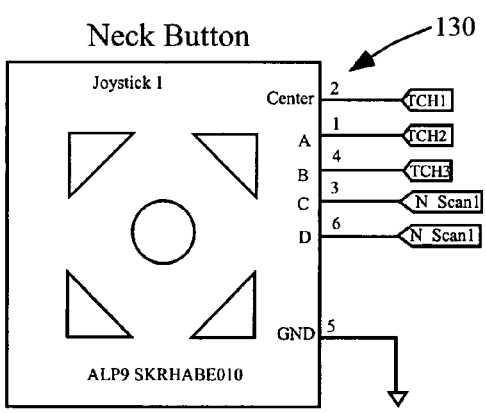
Figure 8F:
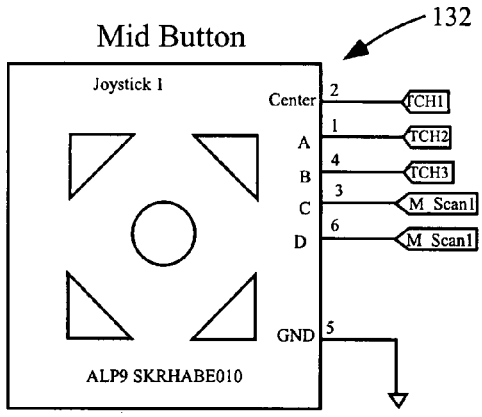
Figure 8G:
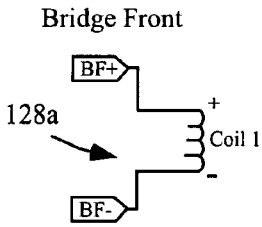
Figure 8H:
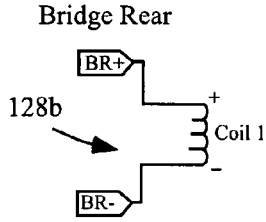
Figure 8I:
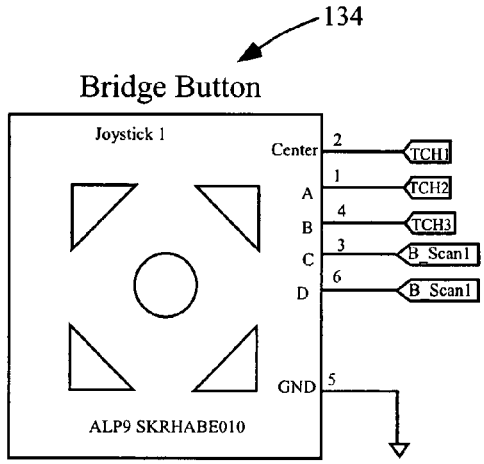

It is to be appreciated that this interface system of the disclosed musical instrument is adaptable to other pickup types, for example, dual-coil, split-coil, and various other pickup configurations, such as two dual-coil pickups, such as those typically used on a Gibson Les Paul, or a combination of single and dual coil pickups on a given instrument. The number of possible wiring combinations (all practically accessible, and manageable via the user interface disclosed herein), is greatly increased by substituting one or more of the single-coil pickups with a dual-coil pickup. In a dual-coil pickup, two transducers are located adjacent to one another, and typically wired to aid in external noise or hum cancellation. The number of combinations is increased if the individual coils are wired separately, or the wiring of the dual-coil pickups' own coils is varied, or if the number of pickups is increased. Schematics for the various components of a dual coil configuration are shown in FIGS. 7 through 9. An example of a processor 140 and connections for a dual coil or humbucker pickup configuration is shown in FIG. 7.

As shown in FIGS. 3 and 8A through 8I, for a dual-coil pickup configuration, alternative user operated controls may be utilized, such as the "joystick" type neck control 130, mid control 132 and bridge control 134, which control, respectively neck front pickup 124*a*, neck rear pickup 124*b*, mid front pickup 126*a*, mid rear pickup 126*b*, bridge front pickup 128*a* and bridge rear pickup 128*b*. As stated above, these joysticks are sometimes also referred to as "navigation switches", and are found in such devices as cell phones or digital cameras. It should be noted that the "joysticks" are each really four or five switches connected together to give the impression of a single switch. There may be as many joysticks as there are pickups to maintain a one-to-one relationship between the pickups and the controls.

Figure 11:
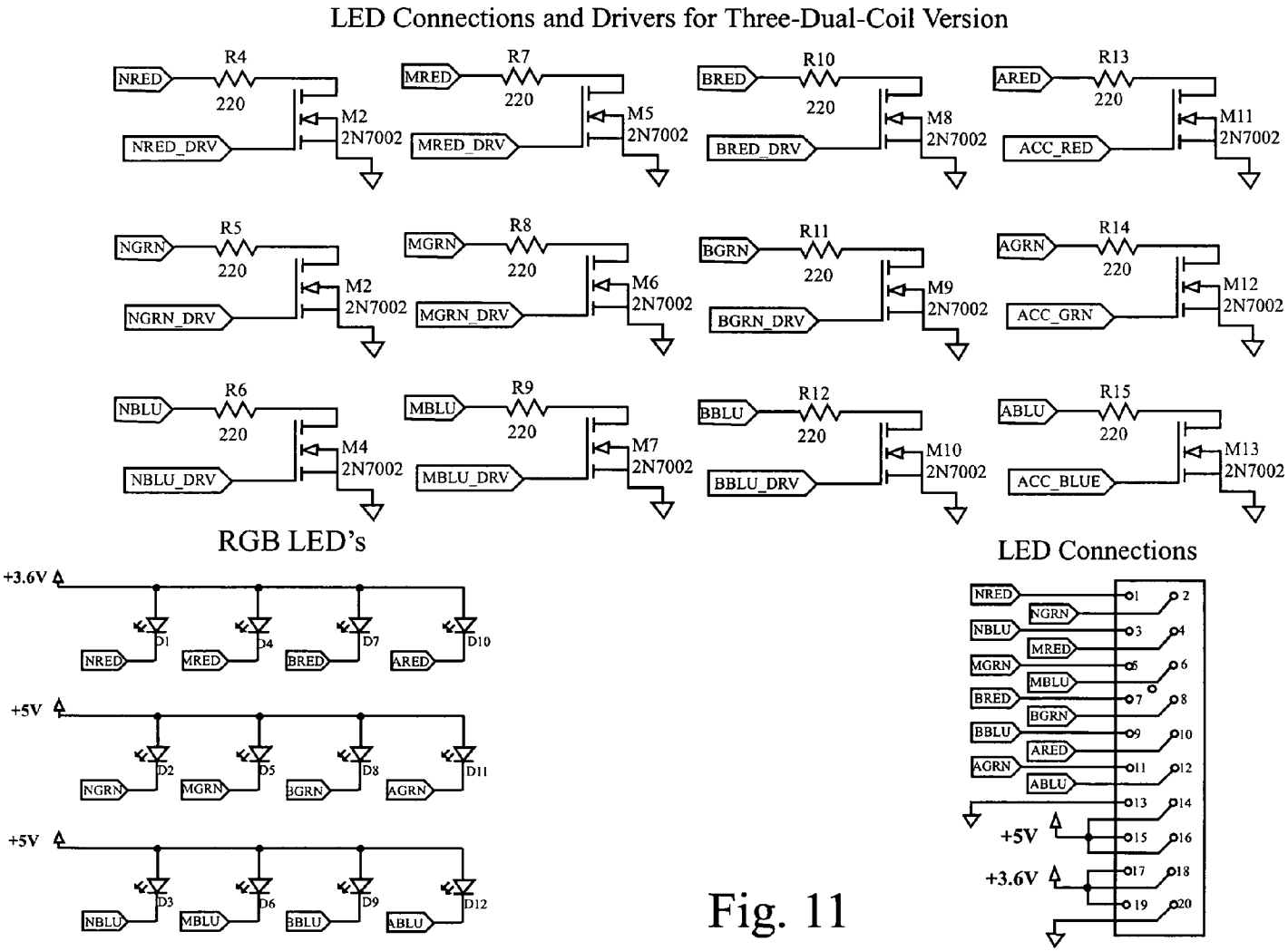
FIG. 11 shows a schematic of an embodiment of a power supply which may be used for instruments having any pickup configuration which may be used with the disclosed apparatus.

In the dual-coil pickup configuration, the illuminated pads/buttons of the interface/display may incorporate RGB LEDs 138, which may be integrated into the joystick controls. These LEDs provide a broad range of color options for indicating the different pickup configurations and wiring arrangements of the individual humbucking pickups. However, it is to appreciated that there remains a single LED (assigned to each pickup) where the LED is located within the pad/button/joystick, as opposed to having multiple LEDs all over the face of an instrument. Utilizing the basic approach discussed above for displaying the status of three single-coil pickups using two colors of LED, one skilled in the art will be capable of configuring the RGB LEDS to display the status of a given pickup configuration. FIG. 11 provides a schematic of the LED connections and drivers for a three dual-coil embodiment.

Figure 12A:
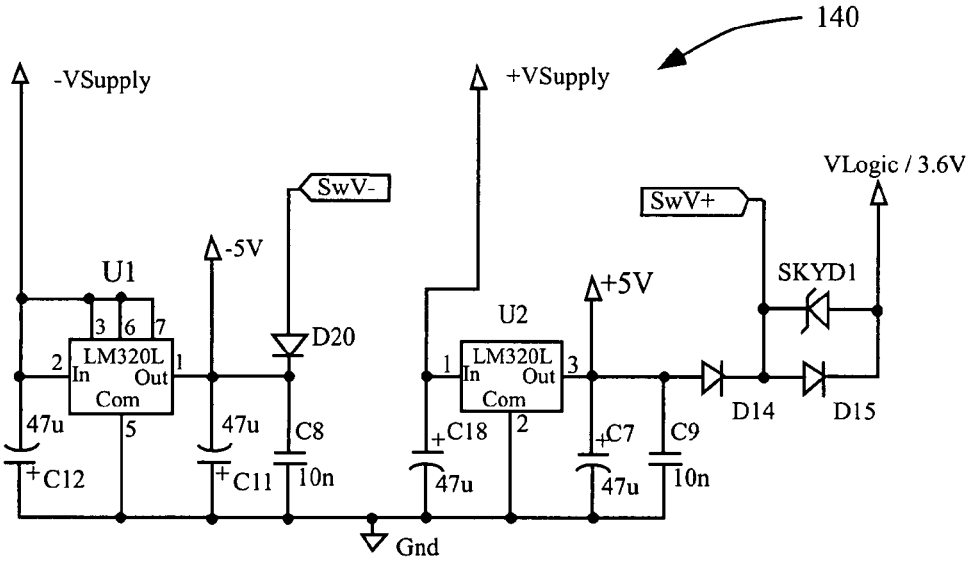
FIG. 12 shows a schematic of possible LED connections and drivers for an instrument having three dual-coil pickups which may be used with the disclosed apparatus.
Figure 12B:
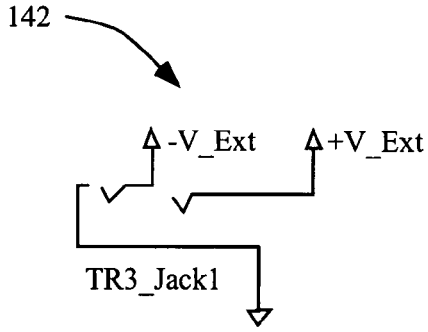
Figure 12C:
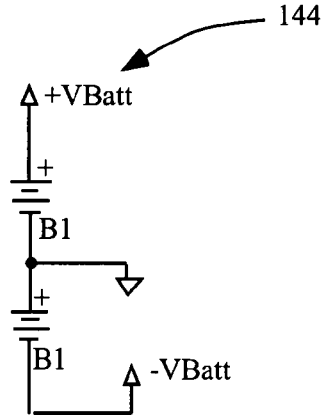
Figure 12D:
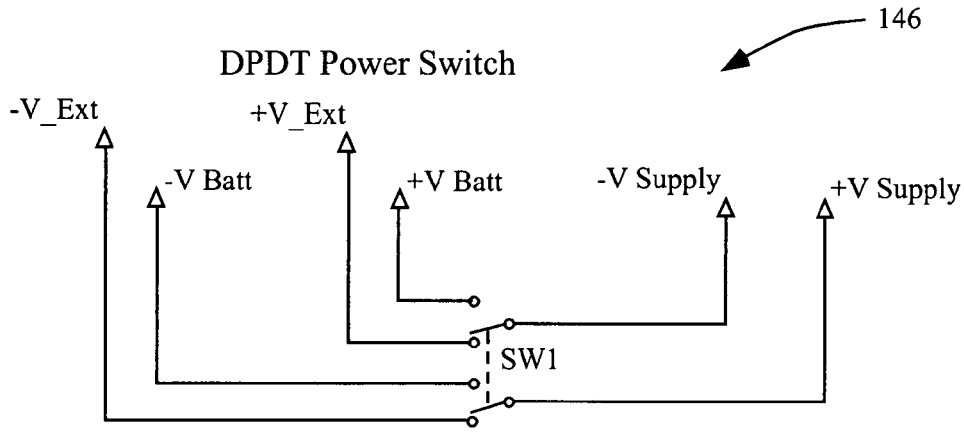

A power supply 140 circuit acceptable for the various embodiments of the device is illustrated schematically in FIG. 12A. As shown in FIG. 12B, the power supply circuit 140 may be powered through an external power connector 142. Alternatively, the power supply circuit may be powered through an internal battery connection 144. Switching between the external power connector 142 and internal battery connector 144 may be made with switch 146.

There appear to be 357 unique combinations from a two dual-coil pickup instrument 10" such as on a Gibson Les Paul. (These combinations are shown in Table II of the following appendices). Adding a single-coil in the Mid position will more than triple the possible combinations, by simply substituting this new coil for each of the others as shown in Table II. In addition, this additional coil can be combined in a series or parallel arrangement with any of the arrangements in Table II as well, such that the total number of possible pickup combinations can at least be quadrupled to somewhere over 1200 possibilities. Further, a dual-coil pickup in the Mid position, will increase the number of possible combinations to an enormous number, well over 2000. This many combinations is too many to store in memory, very tedious to figure all out and not pleasant for a player to visualize on a chart etc. It should be noted that there are dual-coil pickups which are manufactured to be very "skinny" such that they fit into the narrow single-coil slot in lieu of single-coil pickups. These pickups are used to boost signal and cut down on noise without sacrificing single-coil tone. The present apparatus may be utilized for control and monitoring of these types of pickups as well as those already described.

A dual coil pickup is usually wired with the coils in series (reverse wired, around magnetic pole pieces of opposite polarity to cancel unwanted hum, yet producing a strong, desired signal induced in the coils from the interaction of the coils and magnets in response to the motion of the strings). However, the two adjacent coils may be wired together in four arrangements in series-in-phase, in series-out-of-phase, in-parallel-in-phase, or, in-parallel-out-of-phase. Additional useful tones are achieved by using either of the humbucker's two coils individually, often termed a "cut-coil" technique. Likewise different pickup configurations are also achievable with "tapped-coil" or "split-coil" pickups, in which a wire is spliced onto the coil of a pickup, half or part-way down the coil for the purpose of producing a different, usually tonally "brighter" sound. Different configurations are also achievable through the use of additional transducers as of the piezo-electric saddle, or other type. A fourth pickup (pre-amplified or not) may be connected to the other pickups and accessed via an entirely different switch, of any type. Addition of an extra transducer will increase the number of available wiring combinations.

It should therefore be appreciated that, depending upon the number of pickups, the types of pickups, and the wiring of the pickups, there are thousands of acoustically distinct configurations which may be generated from the musical instrument. For the three single-coil system described above having 47 different combinations, the microprocessor may be programmed to use a look-up table to determine, based upon the buttons pressed, which pickup configuration is to be activated, i.e. see what button the person pressed while a particular pickup configuration is active, and turn the switches accordingly, as per a memory-stored chart.

Using the microprocessor in this manner is sometimes referred to as a state-machine approach. In this method, each possible pairing of user input for each possible state (active pickup configuration) is pre-mapped to a particular result (i.e., which switches are flipped).

Figures 9A, 9B:
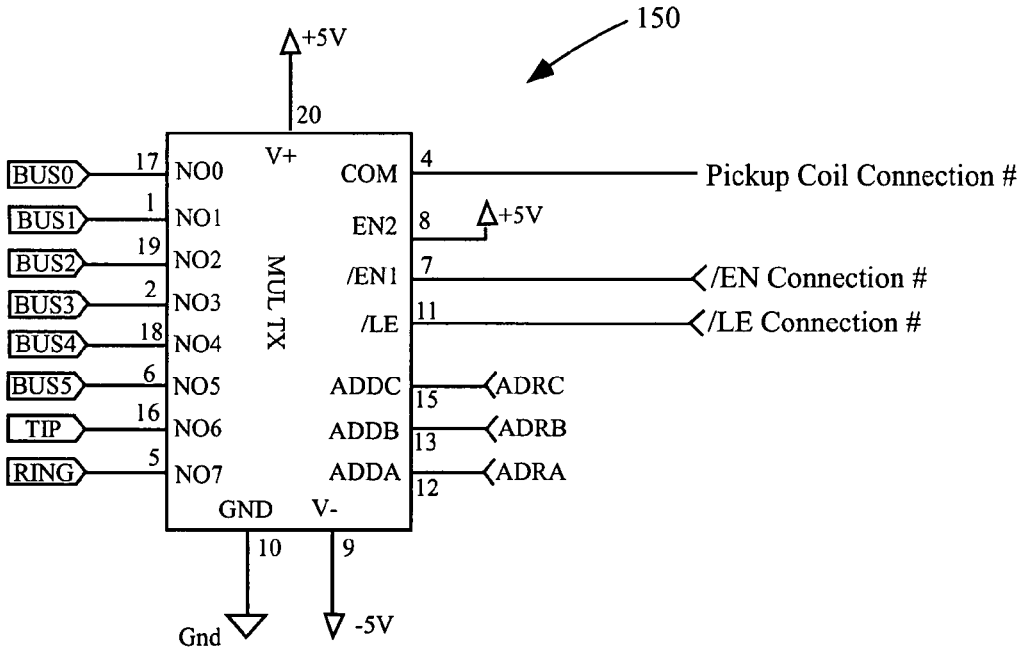
FIG. 9A and FIG. 9B schematically shows how a plurality of digital multiplexers may be connected and utilized for the "on-the-fly" calculation of the bus connections for an instrument having three dual-coil pickups.
Figure 10:
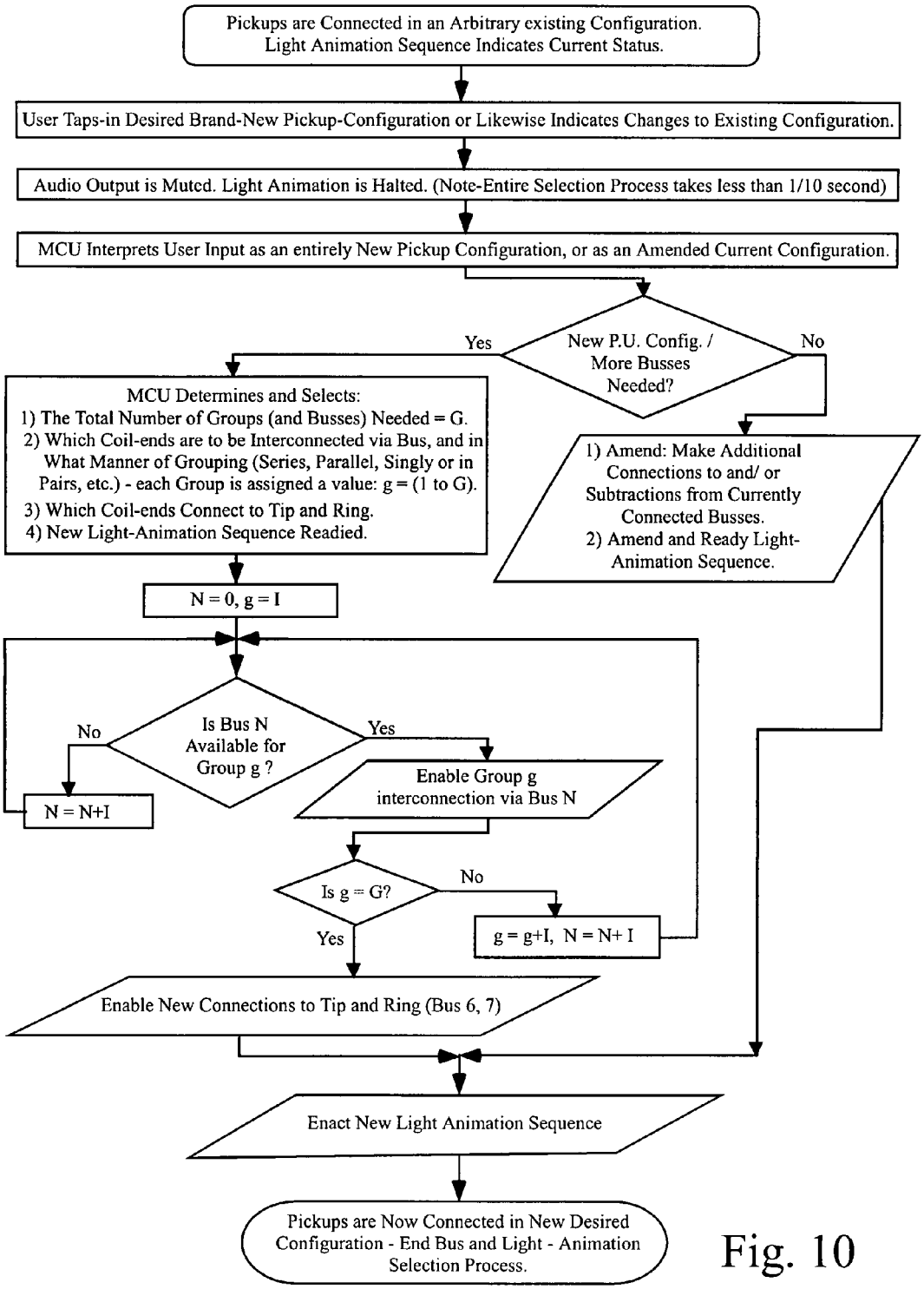
FIG. 10 is a flow chart showing how a microcontroller may be utilized to calculate the interconnections and intra-connections necessary to achieve a desired pickup configuration.

While static control code enumeration for a three-single-coil pickup scheme is readily achieved because there are only forty-seven options, such a system becomes quite cumbersome where there are hundreds of potential options. As an alternative embodiment, and as a way of avoiding the determination of all the connections and coding them into a look-up table, which might require an extraordinary amount of on-board memory, a decision making algorithm may be utilized to arrive at, and map out a routing solution that assigns the connection switching control codes to achieve the user's tapped-in commands on the fly. The decision-making power of the microcontroller is thereby utilized to calculate the interconnection switching by itself, on the fly, as the user taps in the desired pickup configuration. The software includes specific switching for the basics, but then lets the microcontroller decide which of the several audio signal busses to connect the various pickup coils to, to arrive at the desired result. Similar methods are used within the operation of a computer—the kernel or core program decides, on the fly, which program has access to which peripheral, etc. This is a very useful concept to apply to the problem of guitar pickup control, in that there are hundreds of possible pickup configurations and an inordinate amount of ROM would be required to store control code for each configuration. A plurality of multiplex connectors 150 as generally shown in FIG. 9A may be used to accomplish the desired switching by following the algorithm set forth in FIG. 10 While the above is a description of various embodiments of the present invention, further modifications may be employed without departing from the spirit and scope of the present invention. For example, the size, shape, and/or material of the various components may be changed as desired. The present application discusses the combinations found on two popular electric guitars, the Fender Stratocaster and the Gibson Les Paul. However, as known by those skilled in the art of the invention, the disclosed interface system may be adapted for the other pickup configurations discussed above. Thus the scope of the invention should not be limited by the specific structures disclosed. Instead the true scope of the invention should be determined by the claims to be later submitted.

TABLE I

Logic Controlled Pickup Switch Selections -
Yields 47 Unique P.U. Combinations From 3 Pickups by Joel Armstrong-Muntner
|**Pickup Configuration Key:
B or b = Bridge pickup; M or m = Middle pickup; N or n = Neck pickup
+ (plus sign) indicates Parallel Relationship, Upper Case ( B, M, N ) indicate Normal Polarity
− (minus sign) indicates Series Relationship. Lower Case ( b, m, n ) indicate Reverse Polarity

| Combination Selection # | Pickup | This Section Corresponds to Wiring Diagram Switch Selection (only the ON switches are shown, all others are OFF) | | | | | | This Section Corresponds to Schematic Only ON Switches Shown | | |
|---|---|---|---|---|---|---|---|---|---|---|
| Single P.U. | Configuration | Neck Top | Neck Bottom | Mid Top | Mid Bottom | Bridge Top | Bridge Bottom | Neck | Mid | Bridge |
| 1 | N | 8 | 8 | 0 | 0 | 0 | 0 | 0x88 | | |
| 2 | M | 0 | 0 | 8 | 8 | 0 | 0 | | 0x88 | |
| 3 | B | 0 | 0 | 0 | 0 | 8 | 8 | | | 0x88 |
| Two P.U.'s | Configuration | Neck Top | Neck Bottom | Mid Top | Mid Bottom | Bridge Top | Bridge Bottom | Neck | Mid | Bridge |
| 4 | B + M | 0 | 0 | 8 | 8 | 8 | 8 | 0 | 0x88 | 0x88 |
| 5 | B − M | 0 | 0 | 2 | 8 | 8 | 2 | 0 | 0x82 | 0x28 |
| 6 | b + M | 0 | 0 | 8 | 8 | 4 | 4 | 0 | 0x88 | 0x44 |
| 7 | B − m | 0 | 0 | 1 | 2 | 8 | 2 | 0 | 0x21 | 0x28 |
| 8 | N + B | 8 | 8 | 0 | 0 | 8 | 8 | 0x88 | 0 | 0x88 |
| 9 | N − B | 8 | 2 | 0 | 0 | 2 | 8 | 0x28 | 0 | 0x82 |
| 10 | N + b | 4 | 4 | 0 | 0 | 8 | 8 | 0x44 | 0 | 0x88 |
| 11 | N − b | 2 | 4 | 0 | 0 | 2 | 8 | 0x42 | 0 | 0x82 |
| 12 | N + M | 8 | 8 | 8 | 8 | 0 | 0 | 0x88 | 0x88 | 0 |
| 13 | N − M | 8 | 1 | 4 | 8 | 0 | 0 | 0x18 | 0x84 | 0 |
| 14 | n + M | 4 | 4 | 8 | 8 | 0 | 0 | 0x44 | 0x88 | 0 |
| 15 | n − M | 1 | 4 | 4 | 8 | 0 | 0 | 0x41 | 0x84 | 0 |
| Three P.U.'s | Configuration | Neck Top | Neck Bottom | Mid Top | Mid Bottom | Bridge Top | Bridge Bottom | Neck | Mid | Bridge |
| 16 | N + M + B | 8 | 8 | 8 | 8 | 8 | 8 | 0x88 | 0x88 | 0x88 |
| 17 | n + M + B | 4 | 4 | 8 | 8 | 8 | 8 | 0x44 | 0x88 | 0x88 |
| 18 | (N − M) + B | 8 | 1 | 4 | 8 | 8 | 8 | 0x18 | 0x84 | 0x88 |
| 19 | (n − M) + B | 1 | 4 | 4 | 8 | 8 | 8 | 0x41 | 0x84 | 0x88 |
| 20 | (N + M) − B | 8 | 1 | 8 | 4 | 1 | 8 | 0x18 | 0x48 | 0x81 |
| 21 | (n + M) − B | 1 | 4 | 8 | 4 | 1 | 8 | 0x41 | 0x48 | 0x81 |
| 22 | N − M − B | 8 | 2 | 2 | 8 | 2 | 2 | 0x28 | 0x82 | 0x22 |

TABLE I-continued

| | | | | | | | | | | |
|---|---|---|---|---|---|---|---|---|---|---|
| 23 | n − M − B | 2 | 4 | 2 | 8 | 2 | 2 | 0x42 | 0x82 | 0x22 |
| 24 | N + m + B | 4 | 4 | 8 | 8 | 4 | 4 | 0x44 | 0x88 | 0x44 |
| 25 | n + m + B | 8 | 8 | 8 | 8 | 4 | 4 | 0x88 | 0x88 | 0x44 |
| 26 | (n − M) + b | 1 | 4 | 4 | 8 | 4 | 4 | 0x41 | 0x84 | 0x44 |
| 27 | (N − M) + b | 8 | 1 | 4 | 8 | 4 | 4 | 0x18 | 0x84 | 0x44 |
| 28 | (N + m) − B | 8 | 1 | 4 | 1 | 4 | 1 | 0x18 | 0x14 | 0x14 |
| 29 | (N + M) − b | 8 | 1 | 8 | 4 | 4 | 1 | 0x18 | 0x48 | 0x14 |
| 30 | N − m − B | 2 | 4 | 4 | 2 | 4 | 2 | 0x42 | 0x24 | 0x24 |
| 31 | N − M − b | 8 | 1 | 4 | 2 | 4 | 2 | 0x18 | 0x24 | 0x24 |
| 32 | N + (M − B) | 8 | 8 | 8 | 4 | 4 | 1 | 0x88 | 0x48 | 0x14 |
| 33 | N + (m − B) | 8 | 8 | 1 | 2 | 4 | 2 | 0x88 | 0x21 | 0x24 |
| 34 | N − (M + B) | 8 | 1 | 4 | 8 | 1 | 8 | 0x18 | 0x84 | 0x81 |
| 35 | N − (m + B) | 8 | 1 | 4 | 8 | 1 | 8 | 0x18 | 0x84 | 0x81 |
| 36 | N + (m − b) | 4 | 4 | 8 | 4 | 1 | 8 | 0x44 | 0x48 | 0x81 |
| 37 | N + (M − b) | 8 | 8 | 8 | 2 | 4 | 2 | 0x88 | 0x28 | 0x24 |
| 38 | N − (m + b) | 4 | 1 | 8 | 4 | 8 | 1 | 0x14 | 0x48 | 0x18 |
| 39 | N − (M + b) | 8 | 1 | 4 | 8 | 4 | 1 | 0x18 | 0x84 | 0x14 |
| 40 | (N − B) + M | 8 | 2 | 8 | 8 | 2 | 4 | 0x28 | 0x88 | 0x42 |
| 41 | (N − b) + m | 2 | 4 | 8 | 8 | 2 | 8 | 0x42 | 0x88 | 0x82 |
| 42 | (N + B) − M | 8 | 1 | 4 | 8 | 8 | 1 | 0x18 | 0x84 | 0x18 |
| 43 | (N + b) − m | 8 | 1 | 1 | 4 | 1 | 4 | 0x18 | 0x41 | 0x41 |
| 44 | (N − B) + m | 1 | 4 | 8 | 8 | 4 | 1 | 0x41 | 0x88 | 0x14 |
| 45 | (N − b) + M | 8 | 1 | 8 | 8 | 4 | 1 | 0x18 | 0x88 | 0x14 |
| 46 | (N + B) − m | 1 | 4 | 4 | 8 | 1 | 4 | 0x41 | 0x84 | 0x41 |
| 47 | (N + b) − M | 8 | 1 | 4 | 8 | 1 | 4 | 0x18 | 0x84 | 0x41 |
| No Pickups | Configuration | Neck Top | Neck Bottom | Mid Top | Mid Bottom | Bridge Top | Bridge Bottom | Neck | Mid | Bridge |
| 48 | All P.U's Off I | 0 | 0 | 0 | 0 | 0 | 0 | 0 | 0 | 0 |

**Pickup Configuration Key: + (plus sign) indicates a Parallel wiring relationship; − (minus sign) indicates a Series wiring relationship.
Upper Case ( B, M, N ) = Normal Polarity; Lower Case ( b, m, n ) = Reverse Polarity

TABLE II

Dual Humbucker Pickup Configurations and Possible Bus Solutions

| | | Pickup to MUX Connections: Single Coil-Pair Simple Combinations | | | |
|---|---|---|---|---|---|
| # | Configuration | Neck Front + − | Neck Rear + − | Bridge Front + − | Bridge Rear + − |
| 1 | NF | 6 7 | | | |
| 2 | NR | | 6 7 | | |
| 3 | NF + NR | 6 7 | 6 7 | | |
| 4 | NF + nr | 6 7 | 7 6 | | |
| 5 | NF − NR | 6 0 | 0 7 | | |
| 6 | NF − nr | 6 0 | 7 0 | | |
| 7 | BF | | | 6 7 | |
| 8 | BR | | | | 6 7 |
| 9 | BF + BR | | | 6 7 | 6 7 |
| 10 | BF + br | | | 6 7 | 7 6 |
| 11 | BF − BR | | | 6 0 | 0 7 |
| 12 | BF − br | | | 6 0 | 7 0 |

| | | Simple Neck and Bridge Parallel Combinations | | | |
|---|---|---|---|---|---|
| | Configuration | Neck Front + − | Neck Rear + − | Bridge Front + − | Bridge Rear + − |
| 13 | NF + BF | 6 7 | | 6 7 | |
| 14 | NF + bf | 6 7 | | 7 6 | |
| 15 | NF + BR | 6 7 | | | 6 7 |
| 16 | NF + br | 6 7 | | | 7 6 |
| 17 | NF + BF + BR | 6 7 | | 6 7 | 6 7 |
| 18 | NF + BF + br | 6 7 | | 6 7 | 7 6 |
| 19 | NF + bf + br | 6 7 | | 7 6 | 7 6 |
| 20 | NF + bf + BR | 6 7 | | 7 6 | 6 7 |
| 21 | NF + (BF − BR) | 6 7 | | 6 0 | 0 7 |
| 22 | NF + (BF − br) | 6 7 | | 6 0 | 7 0 |
| 23 | NF + (bf − br) | 6 7 | | 0 6 | 7 0 |
| 24 | NF + (bf − BR) | 6 7 | | 0 6 | 0 7 |
| 25 | NR + BF | | 6 7 | 6 7 | |
| 26 | NR + bf | | 6 7 | 7 6 | |
| 27 | NR + BR | | 6 7 | | 6 7 |
| 28 | NR + br | | 6 7 | | 7 6 |

TABLE II-continued

| Dual Humbucker Pickup Configurations and Possible Bus Solutions | | | | |
|---|---|---|---|---|
| 29 | NR + (BF + BR) | 6 7 | 6 7 | 6 7 |
| 30 | NR + (BF + br) | 6 7 | 6 7 | 7 6 |
| 31 | NR + (bf + br) | 6 7 | 7 6 | 7 6 |
| 32 | NR + (bf + BR) | 6 7 | 7 6 | 6 7 |
| 33 | NR + (BF − BR) | 6 7 | 6 0 | 0 7 |
| 34 | NR + (BF − br) | 6 7 | 6 0 | 7 0 |
| 35 | NR + (bf − br) | 6 7 | 0 6 | 7 0 |
| 36 | NR + (bf − BR) | 6 7 | 0 6 | 0 7 |

MORE - Simple Neck and Bridge Parallel Combinations

| | Configuration | Neck Front + − | Neck Rear + − | Bridge Front + − | Bridge Rear + − |
|---|---|---|---|---|---|
| 37 | (NF + NR) + BF | 6 7 | 6 7 | 6 7 | |
| 38 | (NF + NR) + bf | 6 7 | 6 7 | 7 6 | |
| 39 | (NF + NR) + BR | 6 7 | 6 7 | | 6 7 |
| 40 | (NF + NR) + br | 6 7 | 6 7 | | 7 6 |
| 41 | (NF + NR) + (BF + BR) | 6 7 | 6 7 | 6 7 | 6 7 |
| 42 | (NF + NR) + (BF + br) | 6 7 | 6 7 | 6 7 | 7 6 |
| 43 | (NF + NR) + (bf + br) | 6 7 | 6 7 | 7 6 | 7 6 |
| 44 | (NF + NR) + (bf + BR) | 6 7 | 6 7 | 7 6 | 6 7 |
| 45 | (NF + NR) + (BF − BR) | 6 7 | 6 7 | 6 0 | 0 7 |
| 46 | (NF + NR) + (BF − br) | 6 7 | 6 7 | 6 0 | 7 0 |
| 47 | (NF + NR) + (bf − br) | 6 7 | 6 7 | 0 6 | 7 0 |
| 48 | (NF + NR) + (bf − BR) | 6 7 | 6 7 | 0 6 | 0 7 |
| 49 | (NF + nr) + BF | 6 7 | 7 6 | 6 7 | |
| 50 | (NF + nr) + bf | 6 7 | 7 6 | 7 6 | |
| 51 | (NF + nr) + BR | 6 7 | 7 6 | | 6 7 |
| 52 | (NF + nr) + br | 6 7 | 7 6 | | 7 6 |
| 53 | (NF + nr) + (BF + BR) | 6 7 | 7 6 | 6 7 | 6 7 |
| 54 | (NF + nr) + (BF + br) | 6 7 | 7 6 | 6 7 | 7 6 |
| 55 | (NF + nr) + (bf + br) | 6 7 | 7 6 | 7 6 | 7 6 |
| 56 | (NF + nr) + (bf + BR) | 6 7 | 7 6 | 7 6 | 6 7 |
| 57 | (NF + nr) + (BF − BR) | 6 7 | 7 6 | 6 0 | 0 7 |
| 58 | (NF + nr) + (BF − br) | 6 7 | 7 6 | 6 0 | 7 0 |
| 59 | (NF + nr) + (bf − br) | 6 7 | 7 6 | 0 6 | 7 0 |
| 60 | (NF + nr) + (bf − BR) | 6 7 | 7 6 | 0 6 | 0 7 |

EVEN MORE - Simple Neck and Bridge Parallel Combinations

| | Configuration | Neck Front + − | Neck Rear + − | Bridge Front + − | Bridge Rear + − |
|---|---|---|---|---|---|
| 61 | (NF − NR) + BF | 6 0 | 0 7 | 6 7 | |
| 62 | (NF − NR) + bf | 6 0 | 0 7 | 7 6 | |
| 63 | (NF − NR) + BR | 6 0 | 0 7 | | 6 7 |
| 64 | (NF − NR) + br | 6 0 | 0 7 | | 7 6 |
| 65 | (NF − NR) + (BF + BR) | 6 0 | 0 7 | 6 7 | 6 7 |
| 66 | (NF − NR) + (BF + br) | 6 0 | 0 7 | 6 7 | 7 6 |
| 67 | (NF − NR) + (bf + br) | 6 0 | 0 7 | 7 6 | 7 6 |
| 68 | (NF − NR) + (bf + BR) | 6 0 | 0 7 | 7 6 | 6 7 |
| 69 | (NF − NR) + (BF − BR) | 6 0 | 0 7 | 6 1 | 1 7 |
| 70 | (NF − NR) + (BF − br) | 6 0 | 0 7 | 6 1 | 7 1 |
| 71 | (NF − NR) + (bf − br) | 6 0 | 0 7 | 1 6 | 7 1 |
| 72 | (NF − NR) + (bf − BR) | 6 0 | 0 7 | 1 6 | 1 7 |
| 73 | (NF − nr) + BF | 6 0 | 7 0 | 6 7 | |
| 74 | (NF − nr) + bf | 6 0 | 7 0 | 7 6 | |
| 75 | (NF − nr) + BR | 6 0 | 7 0 | | 6 7 |
| 76 | (NF − nr) + br | 6 0 | 7 0 | | 7 6 |
| 77 | (NF − nr) + (BF + BR) | 6 0 | 7 0 | 6 7 | 6 7 |
| 78 | (NF − nr) + (BF + br) | 6 0 | 7 0 | 6 7 | 7 6 |
| 79 | (NF − nr) + (bf + br) | 6 0 | 7 0 | 7 6 | 7 6 |
| 80 | (NF − nr) + (bf + BR) | 6 0 | 7 0 | 7 6 | 6 7 |
| 81 | (NF − nr) + (BF − BR) | 6 0 | 7 0 | 6 1 | 1 7 |
| 82 | (NF − nr) + (BF − br) | 6 0 | 7 0 | 6 1 | 7 1 |
| 83 | (NF − nr) + (bf − br) | 6 0 | 7 0 | 1 6 | 7 1 |
| 84 | (NF − nr) + (bf − BR) | 6 0 | 7 0 | 1 6 | 1 7 |

Simple Neck and Bridge Series Combinations

| | Configuration | Neck Front | Neck Rear | Bridge Front | Bridge Rear |
|---|---|---|---|---|---|
| 85 | NF − BF | 6 0 | | 0 7 | |
| 86 | NF − bf | 6 0 | | 7 0 | |
| 87 | NF − BR | 6 0 | | | 0 7 |
| 88 | NF − br | 6 0 | | | 7 0 |

TABLE II-continued

| Dual Humbucker Pickup Configurations and Possible Bus Solutions | | | | | |
|---|---|---|---|---|---|
| 89 | NF − (BF + BR) | 6 0 | | 0 7 | 0 7 |
| 90 | NF − (BF + br) | 6 0 | | 0 7 | 7 0 |
| 91 | NF − (bf + br) | 6 0 | | 7 0 | 7 0 |
| 92 | NF − (bf + BR) | 6 0 | | 7 0 | 0 7 |
| 93 | NF − (BF − BR) | 6 0 | | 0 1 | 1 7 |
| 94 | NF − (BF − br) | 6 0 | | 0 1 | 7 1 |
| 95 | NF − (bf − br) | 6 0 | | 1 0 | 7 1 |
| 96 | NF − (bf − BR) | 6 0 | | 1 0 | 1 7 |
| 97 | NR − BF | | 6 0 | 0 7 | |
| 98 | NR − bf | | 6 0 | 7 0 | |
| 99 | NR − BR | | 6 0 | | 0 7 |
| 100 | NR − br | | 6 0 | | 7 0 |
| 101 | NR − (BF + BR) | | 6 0 | 0 7 | 0 7 |
| 102 | NR − (BF + br) | | 6 0 | 0 7 | 7 0 |
| 103 | NR − (bf + br) | | 6 0 | 7 0 | 7 0 |
| 104 | NR − (bf + BR) | | 6 0 | 7 0 | 0 7 |
| 105 | NR − (BF − BR) | | 6 0 | 0 1 | 1 7 |
| 106 | NR − (BF − br) | | 6 0 | 0 1 | 7 1 |
| 107 | NR − (bf − br) | | 6 0 | 1 0 | 7 1 |
| 108 | NR − (bf − BR) | | 6 0 | 1 0 | 1 7 |
| MORE Simple Neck and Bridge Series Combinations | | | | | |
| 109 | (NF + NR) − BF | 6 0 | 6 0 | 0 7 | |
| 110 | (NF + NR) − bf | 6 0 | 6 0 | 7 0 | |
| 111 | (NF + NR) − BR | 6 0 | 6 0 | | 0 7 |
| 112 | (NF + NR) − br | 6 0 | 6 0 | | 7 0 |
| 113 | (NF + NR) − (BF + BR) | 6 0 | 6 0 | 0 7 | 0 7 |
| 114 | (NF + NR) − (BF + br) | 6 0 | 6 0 | 0 7 | 7 0 |
| 115 | (NF + NR) − (bf + br) | 6 0 | 6 0 | 7 0 | 7 0 |
| 116 | (NF + NR) − (bf + BR) | 6 0 | 6 0 | 7 0 | 0 7 |
| 117 | (NF + NR) − (BF − BR) | 6 0 | 6 0 | 0 1 | 1 7 |
| 118 | (NF + NR) − (BF − br) | 6 0 | 6 0 | 0 1 | 7 1 |
| 119 | (NF + NR) − (bf − br) | 6 0 | 6 0 | 1 0 | 7 1 |
| 120 | (NF + NR) − (bf − BR) | 6 0 | 6 0 | 1 0 | 1 7 |
| 121 | (NF + nr) − BF | 6 0 | 0 6 | 0 7 | |
| 122 | (NF + nr) − bf | 6 0 | 0 6 | 7 0 | |
| 123 | (NF + nr) − BR | 6 0 | 0 6 | | 0 7 |
| 124 | (NF + nr) − br | 6 0 | 0 6 | | 7 0 |
| 125 | (NF + nr) − (BF + BR) | 6 0 | 0 6 | 0 7 | 0 7 |
| 126 | (NF + nr) − (BF + br) | 6 0 | 0 6 | 0 7 | 7 0 |
| 127 | (NF + nr) − (bf + br) | 6 0 | 0 6 | 7 0 | 7 0 |
| 128 | (NF + nr) − (bf + BR) | 6 0 | 0 6 | 7 0 | 0 7 |
| 129 | (NF + nr) − (BF − BR) | 6 0 | 0 6 | 0 1 | 1 7 |
| 130 | (NF + nr) − (BF − br) | 6 0 | 0 6 | 0 1 | 7 1 |
| 131 | (NF + nr) − (bf − br) | 6 0 | 0 6 | 1 0 | 7 1 |
| 132 | (NF + nr) − (bf − BR) | 6 0 | 0 6 | 1 0 | 1 7 |

Even MORE Simple Neck and Bridge Series Combinations

| | Configuration | Neck Front + − | Neck Rear + − | Bridge Front + − | Bridge Rear + − |
|---|---|---|---|---|---|
| 133 | (NF − NR) − BF | 6 0 | 0 1 | 1 7 | |
| 134 | (NF − NR) − bf | 6 0 | 0 1 | 7 1 | |
| 135 | (NF − NR) − BR | 6 0 | 0 1 | | 1 7 |
| 136 | (NF − NR) − br | 6 0 | 0 1 | | 7 1 |
| 137 | (NF − NR) − (BF + BR) | 6 0 | 0 1 | 1 7 | 1 7 |
| 138 | (NF − NR) − (BF + br) | 6 0 | 0 1 | 1 7 | 7 1 |
| 139 | (NF − NR) − (bf + br) | 6 0 | 0 1 | 7 1 | 7 1 |
| 140 | (NF − NR) − (bf + BR) | 6 0 | 0 1 | 7 1 | 1 7 |
| 141 | (NF − NR) − (BF − BR) | 6 0 | 0 1 | 1 2 | 2 7 |
| 142 | (NF − NR) − (BF − br) | 6 0 | 0 1 | 1 2 | 7 2 |
| 143 | (NF − NR) − (bf − br) | 6 0 | 0 1 | 2 1 | 7 2 |
| 144 | (NF − NR) − (bf − BR) | 6 0 | 0 1 | 2 1 | 2 7 |
| 145 | (NF − nr) − BF | 6 0 | 1 0 | 1 7 | |
| 146 | (NF − nr) − bf | 6 0 | 1 0 | 7 1 | |
| 147 | (NF − nr) − BR | 6 0 | 1 0 | | 1 7 |
| 148 | (NF − nr) − br | 6 0 | 1 0 | | 7 1 |
| 149 | (NF − nr) − (BF + BR) | 6 0 | 1 0 | 1 7 | 1 7 |
| 150 | (NF − nr) − (BF + br) | 6 0 | 1 0 | 1 7 | 7 1 |
| 151 | (NF − nr) − (bf + br) | 6 0 | 1 0 | 7 1 | 7 1 |
| 152 | (NF − nr) − (bf + BR) | 6 0 | 1 0 | 7 1 | 1 7 |
| 153 | (NF − nr) − (BF − BR) | 6 0 | 1 0 | 1 2 | 2 7 |
| 154 | (NF − nr) − (BF − br) | 6 0 | 1 0 | 1 2 | 7 2 |

TABLE II-continued

| Dual Humbucker Pickup Configurations and Possible Bus Solutions | | | | | |
|---|---|---|---|---|---|
| 155 | (NF − nr) − (bf − br) | 6 0 | 1 0 | 2 1 | 7 2 |
| 156 | (NF − nr) − (bf − BR) | 6 0 | 1 0 | 2 1 | 2 7 |

| | | Special Mixed Combinations: Three Coil Combinations: | | | | |
|---|---|---|---|---|---|---|
| | Configuration | Neck Front + − | Neck Rear + − | Bridge Front + − | Bridge Rear + − | |
| 157 | (NF + BF) − NR | 6 0 | 0 7 | 6 0 | | 5 |
| 158 | (NF + BF) − nr | 6 0 | 7 0 | 6 0 | | 5 |
| 159 | (NF + bf) − NR | 6 0 | 0 7 | 0 6 | | 5 |
| 160 | (NF + bf) − nr | 6 0 | 7 0 | 0 6 | | 5 |
| 161 | (NF + BF) − BR | 6 0 | | 6 0 | 0 7 | 5 |
| 162 | (NF + BF) − br | 6 0 | | 6 0 | 7 0 | 5 |
| 163 | (NF + bf) − BR | 6 0 | | 0 6 | 0 7 | 5 |
| 164 | (NF + bf) − br | 6 0 | | 0 6 | 7 0 | 5 |
| 165 | (NF + BR) − NR | 6 0 | 0 7 | | 6 0 | |
| 166 | (NF + BR) − nr | 6 0 | 7 0 | | 6 0 | |
| 167 | (NF + br) − NR | 6 0 | 0 7 | | 6 0 | |
| 168 | (NF + br) − nr | 6 0 | 7 0 | | 6 0 | |
| 169 | (NF + BR) − BF | 6 0 | | 0 7 | 6 0 | |
| 170 | (NF + BR) − bf | 6 0 | | 7 0 | 6 0 | |
| 171 | (NF + br) − BF | 6 0 | | 0 7 | 6 0 | |
| 172 | (NF + br) − bf | 6 0 | | 7 0 | 6 0 | |
| 173 | (NR + BF) − NF | 0 7 | 6 0 | 6 0 | | |
| 174 | (NR + BF) − nf | 7 0 | 6 0 | 6 0 | | |
| 175 | (NR + bf) − NF | 0 7 | 6 0 | 6 0 | | |
| 176 | (NR + bf) − nf | 7 0 | 6 0 | 6 0 | | |
| 177 | (NR + BF) − BR | | 6 0 | 6 0 | 0 7 | |
| 178 | (NR + BF) − br | | 6 0 | 6 0 | 7 0 | |
| 179 | (NR + bf) − BR | | 6 0 | 6 0 | 0 7 | |
| 180 | (NR + bf) − br | | 6 0 | 6 0 | 7 0 | |
| 181 | (NR + BR) − NF | 0 7 | 6 0 | | 6 0 | |
| 182 | (NR + BR) − nf | 7 0 | 6 0 | | 6 0 | |
| 183 | (NR + br) − NF | 0 7 | 6 0 | | 6 0 | |
| 184 | (NR + br) − nf | 7 0 | 6 0 | | 6 0 | |
| 185 | (NR + BR) − BF | | 6 0 | 0 7 | 6 0 | |
| 186 | (NR + BR) − bf | | 6 0 | 7 0 | 6 0 | |
| 187 | (NR + br) − BF | | 6 0 | 0 7 | 6 0 | |
| 188 | (NR + br) − bf | | 6 0 | 7 0 | 6 0 | |
| | Three Coil Combinations, In Parallel With the Other Coil: | | | | | |
| 189 | BR + [(NF + BF) − NR] | 6 0 | 0 7 | 6 0 | 6 7 | |
| 190 | BR + [(NF + BF) − nr] | 6 0 | 7 0 | 6 0 | 6 7 | |
| 191 | BR + [(NF + bf) − NR] | 6 0 | 0 7 | 0 6 | 6 7 | |
| 192 | BR + [(NF + bf) − nr] | 6 0 | 7 0 | 0 6 | 6 7 | |
| 193 | br + [(NF + BF) − NR] | 6 0 | 0 7 | 6 0 | 7 6 | |
| 194 | br + [(NF + BF) − nr] | 6 0 | 7 0 | 6 0 | 7 6 | |
| 195 | br + [(NF + bf) − NR] | 6 0 | 0 7 | 0 6 | 7 6 | |
| 196 | br + [(NF + bf) − nr] | 6 0 | 7 0 | 0 6 | 7 6 | |
| 197 | NR + [(NF + BF) − BR] | 6 0 | 6 7 | 6 0 | 0 7 | |
| 198 | NR + [(NF + BF) − br] | 6 0 | 6 7 | 6 0 | 7 0 | |
| 199 | NR + [(NF + bf) − BR] | 6 0 | 6 7 | 6 0 | 0 7 | |
| 200 | NR + [(NF + bf) − br] | 6 0 | 6 7 | 6 0 | 7 0 | |
| 201 | nr + [(NF + BF) − BR] | 6 0 | 7 6 | 6 0 | 0 7 | |
| 202 | nr + [(NF + BF) − br] | 6 0 | 7 6 | 6 0 | 7 0 | |
| 203 | nr + [(NF + bf) − BR] | 6 0 | 7 6 | 6 0 | 0 7 | |
| 204 | nr + [(NF + bf) − br] | 6 0 | 7 6 | 6 0 | 7 0 | |
| 205 | BF + (NF + BR) − NR] | 6 0 | 0 7 | 6 7 | 6 0 | |
| 206 | BF + (NF + BR) − nr] | 6 0 | 7 0 | 6 7 | 6 0 | |
| 207 | BF + (NF + br) − NR] | 6 0 | 0 7 | 6 7 | 6 0 | |
| 208 | BF + (NF + br) − nr] | 6 0 | 7 0 | 6 7 | 6 0 | |
| 209 | bf + (NF + BR) − NR] | 6 0 | 0 7 | 7 6 | 6 0 | |
| 210 | bf + (NF + BR) − nr] | 6 0 | 7 0 | 7 6 | 6 0 | |
| 211 | bf + (NF + br) − NR] | 6 0 | 0 7 | 7 6 | 6 0 | |
| 212 | bf + (NF + br) − nr] | 6 0 | 7 0 | 7 6 | 6 0 | |
| 213 | NR + [(NF + BR) − BF] | 6 0 | 6 7 | 0 7 | 6 0 | |
| 214 | NR + [(NF + BR) − bf] | 6 0 | 6 7 | 7 0 | 6 0 | |
| 215 | NR + [(NF + br) − BF] | 6 0 | 6 7 | 0 7 | 6 0 | |
| 216 | NR + [(NF + br) − bf] | 6 0 | 6 7 | 7 0 | 6 0 | |
| 217 | nr + [(NF + BR) − BF] | 6 0 | 7 6 | 0 7 | 6 0 | |
| 218 | nr + [(NF + BR) − bf] | 6 0 | 7 6 | 7 0 | 6 0 | |
| 219 | nr + [(NF + br) − BF] | 6 0 | 7 6 | 0 7 | 6 0 | |
| 220 | nr + [(NF + br) − bf] | 6 0 | 7 6 | 7 0 | 6 0 | |
| 221 | BR + [(NR + BF) − NF] | 0 7 | 6 0 | 6 0 | 6 7 | |

TABLE II-continued

| Dual Humbucker Pickup Configurations and Possible Bus Solutions | | | | |
|---|---|---|---|---|
| 222 BR + [(NR + BF) − nf] | 7 0 | 6 0 | 6 0 | 6 7 |
| 223 BR + [(NR + bf) − NF] | 0 7 | 6 0 | 6 0 | 6 7 |
| 224 BR + [(NR + bf) − nf] | 7 0 | 6 0 | 6 0 | 6 7 |
| 225 br + [(NR + BF) − NF] | 0 7 | 6 0 | 6 0 | 7 6 |
| 226 br + [(NR + BF) − nf] | 7 0 | 6 0 | 6 0 | 7 6 |
| 227 br + [(NR + bf) − NF] | 0 7 | 6 0 | 6 0 | 7 6 |
| 228 br + [(NR + bf) − nf] | 7 0 | 6 0 | 6 0 | 7 6 |
| 229 NF + [(NR + BF) − BR] | 6 7 | 6 0 | 6 0 | 0 7 |
| 230 NF + [(NR + BF) − br] | 6 7 | 6 0 | 6 0 | 7 0 |
| 231 NF + [(NR + bf) − BR] | 6 7 | 6 0 | 6 0 | 0 7 |
| 232 NF + [(NR + bf) − br] | 6 7 | 6 0 | 6 0 | 7 0 |
| 233 nf + [(NR + BF) − BR] | 7 6 | 6 0 | 6 0 | 0 7 |
| 234 nf + [(NR + BF) − br] | 7 6 | 6 0 | 6 0 | 7 0 |
| 235 nf + [(NR + bf) − BR] | 7 6 | 6 0 | 6 0 | 0 7 |
| 236 nf + [(NR + bf) − br] | 7 6 | 6 0 | 6 0 | 7 0 |
| 237 BF + [(NR + BR) − NF] | 0 7 | 6 0 | 6 7 | 6 0 |
| 238 BF + [(NR + BR) − nf] | 7 0 | 6 0 | 6 7 | 6 0 |
| 239 BF + [(NR + br) − NF] | 0 7 | 6 0 | 6 7 | 6 0 |
| 240 BF + [(NR + br) − nf] | 7 0 | 6 0 | 6 7 | 6 0 |
| 241 bf + [(NR + BR) − NF] | 0 7 | 6 0 | 7 6 | 6 0 |
| 242 bf + [(NR + BR) − nf] | 7 0 | 6 0 | 7 6 | 6 0 |
| 243 bf + [(NR + br) − NF] | 0 7 | 6 0 | 7 6 | 6 0 |
| 244 bf + [(NR + br) − nf] | 7 0 | 6 0 | 7 6 | 6 0 |
| 245 NF + [(NR + BR) − BF] | 6 7 | 6 0 | 0 7 | 6 0 |
| 246 NF + [(NR + BR) − bf] | 6 7 | 6 0 | 7 0 | 6 0 |
| 247 NF + [(NR + br) − BF] | 6 7 | 6 0 | 0 7 | 6 0 |
| 248 NF + [(NR + br) − bf] | 6 7 | 6 0 | 7 0 | 6 0 |
| 249 nf + [(NR + BR) − BF] | 7 6 | 6 0 | 0 7 | 6 0 |
| 250 nf + [(NR + BR) − bf] | 7 6 | 6 0 | 7 0 | 6 0 |
| 251 nf + [(NR + br) − BF] | 7 6 | 6 0 | 0 7 | 6 0 |
| 252 nf + [(NR + br) − bf] | 7 6 | 6 0 | 7 0 | 6 0 |

| | Special Four Coils Inter-Mixed | | | | |
|---|---|---|---|---|---|
| | Configuration | Neck Front + − | Neck Rear + − | Bridge Front + − | Bridge Rear + − | |
| 253 | (NF + BF) + (NR − BR) | 6 7 | 6 0 | 6 7 | 0 7 | 1 |
| 254 | (NF + BF) + (NR − br) | 6 7 | 6 0 | 6 7 | 7 0 | 1 |
| 255 | (NF + BF) + (nr − br) | 6 7 | 0 6 | 6 7 | 7 0 | 1 |
| 256 | (NF + BF) + (nr − BR) | 6 7 | 0 6 | 6 7 | 0 7 | 1 |
| | | | | | | 1 |
| 257 | (NF + bf) + (NR − BR) | 6 7 | 6 0 | 7 6 | 0 7 | 1 |
| 258 | (NF + bf) + (NR − br) | 6 7 | 6 0 | 7 6 | 7 0 | 1 |
| 259 | (NF + bf) + (nr − br) | 6 7 | 0 6 | 7 6 | 7 0 | 1 |
| 260 | (NF + bf) + (nr − BR) | 6 7 | 0 6 | 7 6 | 0 7 | 1 |
| | | | | | | 1 |
| 261 | (NF − BF) + (NR − BR) | 6 0 | 6 1 | 0 7 | 1 7 | 2 |
| 262 | (NF − BF) + (NR − br) | 6 0 | 6 1 | 0 7 | 7 1 | 2 |
| 263 | (NF − BF) + (nr − br) | 6 0 | 1 6 | 0 7 | 7 1 | 2 |
| 264 | (NF − BF) + (nr − BR) | 6 0 | 1 6 | 0 7 | 1 7 | 2 |
| | | | | | | 2 |
| 265 | (NF − bf) + (NR − BR) | 6 0 | 6 1 | 0 7 | 1 7 | 2 |
| 266 | (NF − bf) + (NR − br) | 6 0 | 6 1 | 0 7 | 7 1 | 2 |
| 267 | (NF − bf) + (nr − br) | 6 0 | 1 6 | 0 7 | 7 1 | 2 |
| 268 | (NF − bf) + (nr − BR) | 6 0 | 1 6 | 0 7 | 1 7 | 2 |
| 269 | (NF + BF) − (NR − BR) | 6 0 | 0 1 | 6 0 | 1 7 | 3 |
| 270 | (NF + BF) − (NR − br) | 6 0 | 0 1 | 6 0 | 7 1 | 3 |
| 271 | (NF + BF) − (nr − br) | 6 0 | 1 0 | 6 0 | 7 1 | 3 |
| 272 | (NF + BF) − (nr − BR) | 6 0 | 1 0 | 6 0 | 1 7 | 3 |
| | | | | | | 3 |
| 273 | (NF + bf) − (NR − BR) | 6 0 | 0 1 | 0 6 | 1 7 | 3 |
| 274 | (NF + bf) − (NR − br) | 6 0 | 0 1 | 0 6 | 7 1 | 3 |
| 275 | (NF + bf) − (nr − br) | 6 0 | 1 0 | 0 6 | 7 1 | 3 |
| 276 | (NF + bf) − (nr − BR) | 6 0 | 1 0 | 0 6 | 1 7 | 3 |
| 277 | (NF − BF) − (NR + BR) | 6 0 | 1 7 | 0 1 | 1 7 | 4 |
| 278 | (NF − BF) − (NR + br) | 6 0 | 1 7 | 0 1 | 7 1 | 4 |
| 279 | (NF − BF) − (nr + br) | 6 0 | 7 1 | 0 1 | 7 1 | 4 |
| 280 | (NF − BF) − (nr + BR) | 6 0 | 7 1 | 0 1 | 1 7 | 4 |
| | | | | | | 4 |
| 281 | (NF − bf) − (NR + BR) | 6 0 | 1 7 | 1 0 | 1 7 | 4 |
| 282 | (NF − bf) − (NR + br) | 6 0 | 1 7 | 1 0 | 7 1 | 4 |
| 283 | (NF − bf) − (nr + br) | 6 0 | 7 1 | 1 0 | 7 1 | 4 |

TABLE II-continued

Dual Humbucker Pickup Configurations and Possible Bus Solutions

| | | | | | | |
|---|---|---|---|---|---|---|
| 284 | (NF − bf) − (nr + BR) | 6 0 | 7 1 | 1 0 | 1 7 | 4<br>4 |

| | Configuration | Neck Front<br>+ − | Neck Rear<br>+ − | Bridge Front<br>+ − | Bridge Rear<br>+ − | |
|---|---|---|---|---|---|---|
| 286 | (NF − BR) + (NR + BF) | 6 0 | 6 7 | 6 7 | 0 7 | 6 |
| 287 | (NF − BR) + (NR + bf) | 6 0 | 6 7 | 7 6 | 0 7 | 6 |
| 288 | (NF − BR) + (nr + bf) | 6 0 | 7 6 | 7 6 | 0 7 | 6 |
| 289 | (NF − BR) + (nr + BF) | 6 0 | 7 6 | 6 7 | 0 7 | 6 |
| 290 | (NF − br) + (NR + BF) | 6 0 | 6 7 | 6 7 | 7 0 | 6 |
| 291 | (NF − br) + (NR + bf) | 6 0 | 6 7 | 7 6 | 7 0 | 6 |
| 292 | (NF − br) + (nr + bf) | 6 0 | 7 6 | 7 6 | 7 0 | 6 |
| 293 | (NF − br) + (nr + BF) | 6 0 | 7 6 | 6 7 | 7 0 | 6 |
| 294 | (NF − BR) + (NR − BF) | 6 0 | 6 1 | 1 7 | 0 7 | 7 |
| 295 | (NF − BR) + (NR − bf) | 6 0 | 6 1 | 7 1 | 0 7 | 7 |
| 296 | (NF − BR) + (nr − bf) | 6 0 | 1 6 | 7 1 | 0 7 | 7 |
| 297 | (NF − BR) + (nr − BF) | 6 0 | 1 6 | 1 7 | 0 7 | 7 |
| 298 | (NF − br) + (NR − BF) | 6 0 | 6 1 | 1 7 | 7 0 | 7 |
| 299 | (NF − br) + (NR − bf) | 6 0 | 6 1 | 7 1 | 7 0 | 7 |
| 300 | (NF − br) + (nr − bf) | 6 0 | 1 6 | 7 1 | 7 0 | 7 |
| 301 | (NF − br) + (nr − BF) | 6 0 | 1 6 | 1 7 | 7 0 | 7 |
| 302 | (NF + BR) − (NR − BF) | 6 0 | 0 1 | 1 7 | 6 0 | 8 |
| 303 | (NF + BR) − (NR − bf) | 6 0 | 0 1 | 7 1 | 6 0 | 8 |
| 304 | (NF + BR) − (nr − bf) | 6 0 | 1 0 | 7 1 | 6 0 | 8 |
| 305 | (NF + BR) − (nr − BF) | 6 0 | 1 0 | 1 7 | 6 0 | 8 |
| 306 | (NF + br) − (NR − BF) | 6 0 | 0 1 | 1 7 | 0 6 | 8 |
| 307 | (NF + br) − (NR − bf) | 6 0 | 0 1 | 7 1 | 0 6 | 8 |
| 308 | (NF + br) − (nr − bf) | 6 0 | 1 0 | 7 1 | 0 6 | 8 |
| 309 | (NF + br) − (nr − BF) | 6 0 | 1 0 | 1 7 | 0 6 | 8 |
| 310 | (NF − BR) − (NR + BF) | 6 0 | 1 7 | 1 7 | 0 1 | 9 |
| 311 | (NF − BR) − (NR + bf) | 6 0 | 1 7 | 7 1 | 0 1 | 9 |
| 312 | (NF − BR) − (nr + bf) | 6 0 | 7 1 | 7 1 | 0 1 | 9 |
| 313 | (NF − BR) − (nr + BF) | 6 0 | 7 1 | 1 7 | 0 1 | 9 |
| 314 | (NF − br) − (NR + BF) | 6 0 | 1 7 | 1 7 | 1 0 | 9 |
| 315 | (NF − br) − (NR + bf) | 6 0 | 1 7 | 7 1 | 1 0 | 9 |
| 316 | (NF − br) − (nr + bf) | 6 0 | 7 1 | 7 1 | 1 0 | 9 |
| 317 | (NF − br) − (nr + BF) | 6 0 | 7 1 | 1 7 | 1 0 | 9 |
| 318 | (NF + BR) + (NR − BF) | 6 7 | 6 0 | 0 7 | 6 7 | 10 |
| 319 | (NF + BR) + (NR − bf) | 6 7 | 6 0 | 7 0 | 6 7 | 10 |
| 320 | (NF + BR) + (nr − bf) | 6 7 | 0 6 | 7 0 | 6 7 | 10 |
| 321 | (NF + BR) + (nr − BF) | 6 7 | 0 6 | 0 7 | 6 7 | 10 |
| 322 | (NF + br) + (NR − BF) | 6 7 | 6 0 | 0 7 | 7 6 | 10 |
| 323 | (NF + br) + (NR − bf) | 6 7 | 6 0 | 7 0 | 7 6 | 10 |
| 324 | (NF + br) + (nr − bf) | 6 7 | 0 6 | 7 0 | 7 6 | 10 |
| 325 | (NF + br) + (nr − BF) | 6 7 | 0 6 | 0 7 | 7 6 | 10 |

Three Parallel Coils - All In Series With The Fourth Coil

| | Configuration | Neck Front<br>+ − | Neck Rear<br>+ − | Bridge Front<br>+ − | Bridge Rear<br>+ − | |
|---|---|---|---|---|---|---|
| 326 | (NF + NR + BF) − BR | 6 0 | 6 0 | 6 0 | 0 7 | 51 |
| 327 | (nf + NR + BF) − BR | 0 6 | 6 0 | 6 0 | 0 7 | 51 |
| 328 | (NF + nr + BF) − BR | 6 0 | 0 6 | 6 0 | 0 7 | 51 |
| 329 | (NF + NR + bf) − BR | 6 0 | 6 0 | 0 6 | 0 7 | 51 |
| 330 | (NF + NR + BF) − br | 6 0 | 6 0 | 6 0 | 7 0 | 51 |
| 331 | (nf + NR + BF) − br | 0 6 | 6 0 | 6 0 | 7 0 | 51 |
| 332 | (NF + nr + BF) − br | 6 0 | 0 6 | 6 0 | 7 0 | 51 |
| 333 | (NF + NR + bf) − br | 6 0 | 6 0 | 0 6 | 7 0 | 51 |
| 334 | (NF + NR + BR) − BF | 6 0 | 6 0 | 0 7 | 6 0 | 52 |
| 335 | (nf + NR + BR) − BF | 0 6 | 6 0 | 0 7 | 6 0 | 52 |
| 336 | (NF + nr + BR) − BF | 6 0 | 0 6 | 0 7 | 6 0 | 52 |
| 337 | (NF + NR + br) − BF | 6 0 | 6 0 | 0 7 | 0 6 | 52 |
| 338 | (NF + NR + BR) − bf | 6 0 | 6 0 | 7 0 | 6 0 | 52 |
| 339 | (nf + NR + BR) − bf | 0 6 | 6 0 | 7 0 | 6 0 | 52 |
| 340 | (NF + nr + BR) − bf | 6 0 | 0 6 | 7 0 | 6 0 | 52 |
| 341 | (NF + NR + br) − bf | 6 0 | 6 0 | 7 0 | 0 6 | 52 |
| 342 | NF − (NR + BF + BR) | 0 7 | 6 0 | 6 0 | 6 0 | 53 |
| 343 | NF − (nr + BF + BR) | 0 7 | 0 6 | 6 0 | 6 0 | 53 |
| 344 | NF − (NR + bf + BR) | 0 7 | 6 0 | 0 6 | 6 0 | 53 |
| 345 | NF − (NR + BF + br) | 0 7 | 6 0 | 6 0 | 0 6 | 53 |
| 346 | nf − (NR + BF + BR) | 7 0 | 6 0 | 6 0 | 6 0 | 53 |
| 347 | nf − (nr + BF + BR) | 7 0 | 0 6 | 6 0 | 6 0 | 53 |
| 348 | nf − (NR + bf + BR) | 7 0 | 6 0 | 0 6 | 6 0 | 53 |
| 349 | nf − (NR + BF + br) | 7 0 | 6 0 | 6 0 | 0 6 | 53 |
| 350 | NR − (NF + BF + BR) | 6 0 | 0 7 | 6 0 | 6 0 | 54 |

TABLE II-continued

| Dual Humbucker Pickup Configurations and Possible Bus Solutions | | | | | | |
|---|---|---|---|---|---|---|
| 351 | NR – (nf + BF + BR) | 0 6 | 0 7 | 6 0 | 6 0 | 54 |
| 352 | NR – (NF + bf + BR) | 6 0 | 0 7 | 0 6 | 6 0 | 54 |
| 353 | NR – (NF + BF + br) | 6 0 | 0 7 | 6 0 | 0 6 | 54 |
| 354 | nr – (NF + BF + BR) | 6 0 | 7 0 | 6 0 | 6 0 | 54 |
| 355 | nr – (nf + BF + BR) | 0 6 | 7 0 | 6 0 | 6 0 | 54 |
| 356 | nr – (NF + bf + BR) | 6 0 | 7 0 | 0 6 | 6 0 | 54 |
| 357 | nr – (NF + BF + br) | 6 0 | 7 0 | 6 0 | 0 6 | 54 |

What is claimed is:

1. A string musical instrument comprising:

a plurality of sound pickups, the sound pickups having coils;

a plurality of busses available for transmitting electrical signals from the sound pickups to an output means;

a user operated control in communication with a digital processing means, the digital processing means configured to selectively connect the coils in different combinations to connect the coils in a combination desired by the user wherein the digital processing means determines the bus configuration required to transmit the electrical signals from the sound pickups to the output means for the combination desired by the user; and display means connected to the processing means, the display means providing a unique display indicating the coils are connected in the combination desired by the user.

2. The string musical instrument of claim 1 wherein each sound pickup has a corresponding user operated control.

3. The string musical instrument of claim 1 wherein the display means is integral to the user operated control.

4. The string musical instrument of claim 1 wherein the display means comprise a plurality of light emitting diodes.

5. The string musical instrument of claim 4 wherein the light emitting diodes are bi-color.

6. The string musical instrument of claim 4 wherein the light emitting diodes are RGB LEDS.

7. The string musical instrument of claim 1 wherein the display means comprises a bi-color light emitting diode corresponding with each sound pickup.

8. The string musical instrument of claim 3 wherein the user operated control comprises an illuminated touch pad.

9. The string musical instrument of claim 3 wherein the user operated control comprises an illuminated momentary button.

10. A string musical instrument comprising:

a first sound pickup and a second sound pickup, a first user operated control corresponding to the first sound pickup and a second user operated control corresponding to the second sound pickup, the first user operated control configured to selectively activate the first sound pickup and the second user operated control configured to selectively activate the second sound pickup;

a plurality of busses available for transmitting the electrical signals from the first sound pickup and the second sound pickup to an output means;

the first user operated control and the second user operated control in communication with a digital processing means, the digital processing means configured to selectively connect the coils in different combinations to connect the coils in a combination desired by the user wherein the digital processing means determines the bus configuration required to transmit the electrical signals from the first sound pickup and the second sound pickup to the output means for the combination desired by the user; and a display means comprising a first light emitting diode corresponding to the first sound pickup and a second light emitting diode corresponding to the second sound pickup, the display means connected to the processing means, the processing means causing the display means to provide a coordinated illumination of the first light emitting diode and the second light emitting diode, wherein the coordinated illumination provides a unique display for each of the combinations desired by the user.

11. The string musical instrument of claim 10 wherein the first light emitting diode comprises a bi-color light emitting diode and the second light emitting diode comprises a bi-color light emitting diode.

12. The string musical instrument of claim 10 where the first user operated control comprises a first illuminated momentary button and the second user operated control comprises a second illuminated momentary button.

13. The string musical instrument of claim 11 wherein the coordinated illumination comprises:

the periodic illumination of the first bi-color light emitting diode if the first sound pickup is activated;

the periodic illumination of the second bi-color light emitting diode if the second sound pickup is activated; and the periodic illumination of the first bi-color light emitting diode and the second bi-color light emitting diode in the same color if the user selects the first sound pickup and the second sound pickup to be in-phase and the periodic illumination of the first bi-color light emitting diode and the second bi-color light emitting diode in different colors if the user selects the first sound pickup and the second sound pickup to be out-of-phase.

14. The string musical instrument of claim 12 wherein the coordinated illumination comprises the simultaneous illumination of the first bi-color light emitting diode and the second bi-color light emitting diode if the user selects the first sound pickup and the second sound pickup to be in parallel and the sequential illumination of the first bi-color light emitting diode and the second bi-color light emitting diode if the user selects the first sound pickup and the second sound pickup to be in series.

15. The string musical instrument of claim 10 wherein the first sound pickup comprises a dual-coil pickup.

16. The string musical instrument of claim 15 wherein the first light emitting diode comprises an RGB LED.

17. The string musical instrument of claim 16 wherein the coordinated illumination comprises the periodic illumination of the first RGB LED in a first color if the user selects the first sound pickup to be activated as series-in-phase and the first RGB LED is periodically illuminated in a second color if the user selects the first sound pickup to be activated as series out-of phase.

18. The string musical instrument of claim 16 wherein the coordinated illumination comprises the periodic illumination of the first RGB LED in a third color if the user selects the first sound pickup to be activated as parallel-in-phase and the first RGB LED is periodically illuminated in a fourth color if the user selects the first sound pickup to be activated as parallel-out-of-phase.

19. The string musical instrument of claim 15 wherein the first user operated control comprises a joy stick.

20. A string musical instrument comprising:

a plurality of sound pickups, the sound pickups having coils;

a plurality of busses available for transmitting electrical signals from the sound pickups to an output means; and a user operated control in communication with a digital processing means, the digital processing means configured to selectively connect the coils in different combinations to connect the coils in a combination desired by the user wherein the digital processing means calculates the bus configuration required to transmit the electrical signals from the sound pickups to the output means for the combination desired by the user.

* * * * *